US006664487B2

(12) United States Patent
Takenaka et al.

(10) Patent No.: US 6,664,487 B2
(45) Date of Patent: Dec. 16, 2003

(54) LIMIT SWITCHES

(75) Inventors: Hidemitsu Takenaka, Kyoto (JP); Hiroyuki Kaijo, Kyoto (JP); Tetsuhiko Miyoshi, Kyoto (JP)

(73) Assignee: Omron Corporation, Kyoto (JP)

( * ) Notice: Subject to any disclaimer, the term of this patent is extended or adjusted under 35 U.S.C. 154(b) by 0 days.

(21) Appl. No.: 10/180,951

(22) Filed: Jun. 24, 2002

(65) Prior Publication Data

US 2003/0010614 A1 Jan. 16, 2003

(30) Foreign Application Priority Data

Jul. 10, 2001 (JP) ..... 2001-209878
Jul. 10, 2001 (JP) ..... 2001-209916

(51) Int. Cl.[7] ..... H01H 3/16
(52) U.S. Cl. ..... 200/47
(58) Field of Search ..... 200/47

(56) References Cited

U.S. PATENT DOCUMENTS 3,045,503 A * 7/1962 Kiessling ..... 74/395
3,275,764 A * 9/1966 Kiessling et al. ..... 200/47
3,590,177 A * 6/1971 Ustin et al. ..... 200/17 R
4,133,991 A * 1/1979 Takase ..... 200/47
4,847,453 A * 7/1989 Newell et al. ..... 200/47
4,897,754 A * 1/1990 Konishi et al. ..... 361/1
5,028,748 A * 7/1991 Sakamoto ..... 200/47

* cited by examiner

*Primary Examiner*—Michael Friedhofer
(74) *Attorney, Agent, or Firm*—Beyer Weaver & Thomas LLP

(57) ABSTRACT

A limit switch has switch areas and a partition wall in between in a switch case for containing switch element units separately and independently. An inner case includes covers for sealing the switch areas. For improving rigidity, a switch unit and a head unit which operates the switch unit are connected by means of a protrusion on one of them and an indentation on the other of them, the protrusion and the indentation being engaged in an embracing fashion for strength.

22 Claims, 16 Drawing Sheets

LIMIT SWITCHES

BACKGROUND OF THE INVENTION

This invention relates to limit switches used for detection of objects or the like such as safety limit switches which have passed certain safety standard tests including the dielectric strength test, the electrical endurance test and the cable strength test.

FIG. 29A shows an example of prior art limit switch S-1, comprising a switch unit 190 and a head unit 191. The switch unit 190 includes a case 192 and a plunger 193 and also contains an inner switch 194 with a mobile switch plunger 195. The switch plunger 195 supports two mobile members (not shown) and is contained inside a switch plunger holder (not shown) by means of a returning spring (not shown). Mobile contact points (not shown) on the mobile members and fixed points of a fixed terminal (not shown) form a contact point part. The head unit 191 includes a rotary shaft 197 rotatably supported by a head case 196. A roller lever 199 with a roller 198 is attached to an end part of this rotary shaft 197, and a cam 200 is provided to the rotary shaft 197. The limit switch is formed by attaching the head unit 191 to the switch unit 190 such that the plunger 193 is pushed against the cam 200 of the rotary shaft 197. The head unit 191 is attached to the switch unit 190 by placing the head unit 191 on top of the switch unit 190, pushing in screws (not shown) into holes formed in the head case 196 of the head unit 191 and engaging these screws in threaded holes (not shown) formed in the case 192 of the switch unit 190. This method of attachment, however, did not provide enough rigidity.

The limit switch is operated by moving a so-called dog (not shown) to cause the roller 198 of the limit switch to contact the dog and to tilt the roller lever 199. As the roller lever 199 is tilted, the rotary shaft 197 is rotated to push the plunger 193 such that the switch plunger 195 of the inner switch 194 is pressed and the inner switch carries out a switching operation.

With a prior art limit switch, if the number of circuits for the inner switch 194 is increased, the total number of components increases and the inner switch 194 becomes too large, causing the limit switch as a whole to become also too large. If each constituent parts is made small so as to prevent the limit switch from becoming too large, however, it becomes difficult to produce a switch which can pass safety tests.

For attaching the limit switch to a target structure 201 (such as a wall), as shown in FIG. 29B, a screw 202 is passed through a screw hole 192A in the case 192 of the switch unit 190 and is screwed into the target structure 201. With a prior art limit switch, the attachment between the head unit 191 to the switch unit 190 was not sufficiently rigid, as explained above. If an object 203 is unexpectedly inserted or falls into the space between the head unit 191 and the target structure 201 to which the limit switch is to be attached, as shown in FIG. 29B, the head unit 191 may tilt forward as the screw 202 is tightened, causing the limit switch be deformed or otherwise damaged. If the limit switch is provided with an attachment member for attaching it to a target structure (such as shown at 201) and if there is a gap provided between the attachment member and the target structure, furthermore, it is necessary to fill the gap with a spacer or the like for preventing deformation and breakage.

Another problem with prior art limit switches was that any attempt to improve their sensitivity in response to the market demand had adverse effects on resistance against vibrations, shocks and telegraphing.

SUMMARY OF THE INVENTION

It is therefore an object of this invention to provide a limit switch which need not be increased in size to satisfy the safety requirements of regulations although the total number of circuits is increased.

It is another object of the invention to provide a limit switch which is sufficiently strong and hence does not become deformed or damaged at the time of attachment and hence does not require extra components for preventing deformation and breakage or damage easily even if an unwanted object is inserted between the head unit and the target structure on which it is to be attached.

A limit switch embodying this invention may be characterized not only as comprising an inner switch having a plurality (say, more than four) of switch element units and an inner case, the inner case containing the inner switch and having covers and a switch case, a partition wall being provided such that independently provided switch areas sandwich the partition wall in between, and the switch element units being distributed individually into these switch areas, and the covers each sealing a corresponding one of the switch areas such that insulation characteristics can be improved. Screening members may be further provided for separating the switch element units when they are contained in the switch areas.

Each switch element unit comprises a fixed terminal having two (first and second) fixed contact points, a mobile member having two (first and second) mobile contact points and a switch plunger. The first fixed contact point and the first mobile contact point together form a first contact unit, and the second fixed contact point and the second mobile contact point together form a second contact unit. The switch plunger serves to open and close these contact units.

The switch areas include a part for containing the switch plunger ("switch plunger containing part"), parts for attaching the fixed terminals ("fixed terminal attachment parts") sandwiching the switch plunger containing part from both sides, and lead line areas for keeping lead lines disposed along the fixed terminal installation parts and connected to the fixed terminals. With the switch areas thus structured, the number of switch element units may be increased without increasing the size of the limit switch without adversely affecting the safety characteristics.

The fixed terminal attachment parts include a plurality of fixed terminal installation parts for detachably installing the fixed terminals along the direction in which the switch plunger moves. The switch plunger comprises a switch plunger main body having a plurality of mobile members detachably attached and an elastic holder for holding and applying a biasing force on the mobile members. The fixed terminals are detachably set to the fixed terminal installation parts, and the switch plunger is biased by a returning spring when contained movably inside the switch plunger containing part. With a limit switch thus structured, the structure of contact units can be modified without using different components and only by changing the position of the mobile member, making it possible to develop an increased number of variations. Moreover, since common components will be used, it does not incur any extra cost to develop such variations in the structure of the contact units.

A limit switch of this invention may comprise plunger means for operating inner switches, including a link plunger for operating switch plungers of a plurality of inner switches. With such a structure, a link plunger as a different component can operate the switch plunger s of a plurality of inner switches and since this does not depend on the shape of the actuator, it becomes easier to develop variations.

The main body of the case may be provided with a hole part for the link plunger to pass through and a seal cap holder at this hole part for holding a seal cap. The link plunger has a plunger engaging part. The seal cap comprises a cap main body made of an elastic material with two (first and second) engaging parts at end parts of the cap main body, one of them formed as an O-ring. The link plunger is attached to the seal cap by engaging the first engaging part with the plunger engaging part and the second engaging part with the seal cap holder. Since the seal cap has the function of an O-ring, a more reliable sealing can be effected and the link plunger can follow the motion of the switch plunger more efficiently.

The inner case may also include a fastening case such that the cable of lead lines will be sandwiched between the switch case and this fastening case as the lead lines of the cable are connected to the inner switch and the switch case is fastened to the fastening case. With such a structure, the sealing resin (adhesive) can be effectively prevented from flowing into the inner switch.

The fastening case may be connected to the lead lines of the cable. The cable may have a sealing member with a sealing ring outside. The fastening case may have a cable-passing hole for passing the cable through. The sealing member is inserted into this cable-passing hole. The fastening case has seal holders and the cable is sealed by pressing the sealing ring with the seal holders.

One advantage of connecting the lead lines to the fixed terminal by compression is that solder does not have to be used for the purpose and the production method is gentler to the environment.

Compressing means such as protrusions may be provided on the inner surface of the switch cover for a portion of the lead lines. When a plurality of switch element units are disposed separately in the switch areas, each being covered by its own switch cover, the connection of the lead lines can be secured because such compression means is used to apply compressive force.

The switch case may be provided with an elastic grounding line holder for holding a grounding line and causing it to contact the main body of the switch. One advantage of this method of attachment is that it is not necessary to drill a hole through a portion of the outer case where the grounding line is to be attached.

The invention also teaches to arrange the lead lines symmetrically inside the cable such that the limit switch can be made compact and the arrangement of the lead lines becomes simpler.

In order to improve the rigidity, the limit switch of this invention may be characterized as comprising a switch unit, a head unit which operates the switch unit, a protrusion on either of the switch unit and the head unit and an indentation on the other such that the head unit is connected to the switch unit by engaging the protrusion in the indentation. Rigidity improves because the protrusion and the indentation engage each other in a manner of embracing each other. The switch unit comprises a switch main body having shoulders, the protrusion being formed by steps at the shoulders. The head unit has a head case with two legs protruding to form the indentation therebetween. The protrusion has an attachment hole part. A screw member is inserted in this attachment hole part and compresses the legs to the protrusion so as to fasten the switch main body and the head case together. The switch unit contains an inner switch, and the limit switch further comprises a head unit displacing means for moving the head unit in the direction of movement of the switch plunger. The head unit displacing means may include a spacer inserted between the head unit and the switch unit.

The head unit may include a head case and a rotary shaft rotatably supported by the head case, the head case displays two or more set zones, the rotary shaft having a zone indicator for selectively indicating one of these set zones. When two or more inner switches with different operating characteristics are included, these set zones can be selectively utilized. Since only one head unit is needed for two or more inner switches, the present invention contributes to the reduction in cost.

The limit switch may comprise a lever for rotating the rotary shaft, a lever angle adjuster supporting the lever, and a roulette part formed on a portion of a peripheral part of the lever angle adjuster. The rotary shaft and the lever angle adjuster engage to each other through the roulette part. This lever may be a form lock lever having a pair of holes which are elongated in the direction of the lever and gear parts on the elongated holes. The lever angle adjuster is provided with a pair of lever holders with lever engaging parts. The lever holders are inserted to the elongated holes so as to engage the gear parts with the lever engaging parts so as to connect the form lock lever with the lever angle adjuster.

The head unit includes an actuator for operating the switch head. The actuator comprises a roller to be contacted by a mobile member and a lever which supports the roller. The lever tilts when the mobile member contacts the roller. A weight may be provided on the lever at a position opposite to the roller.

BRIEF DESCRIPTION OF THE DRAWINGS

Throughout herein, corresponding components are indicated by the same symbols or numerals and are not always described repetitiously even where they are components of different limit switches according to different embodiments of the invention.

DETAILED DESCRIPTION OF THE INVENTION

The invention is described next by way of an example with reference to FIGS. 1–21.

Figure 1:
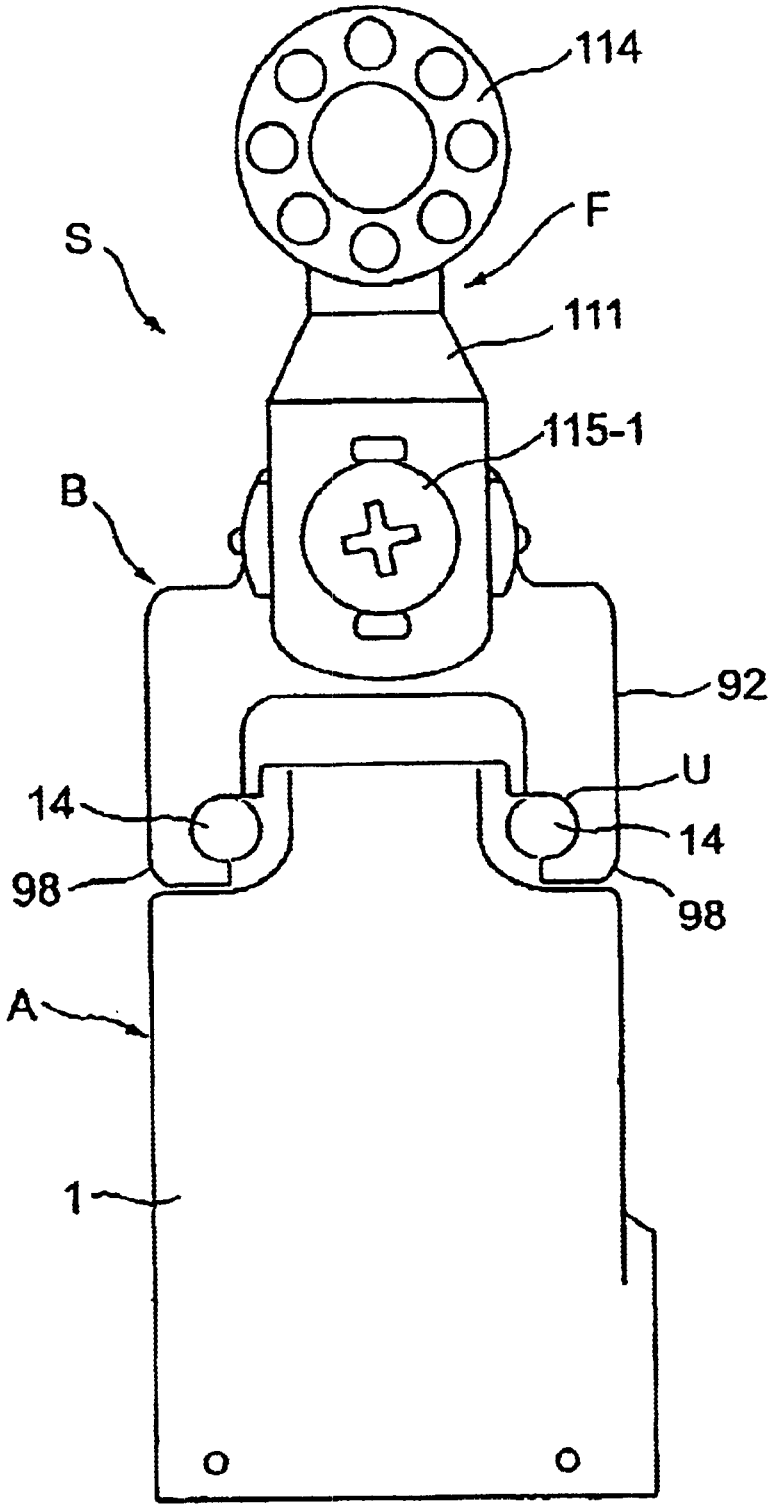
FIG. 1 is a front view of a limit switch embodying this invention.
Figure 2:
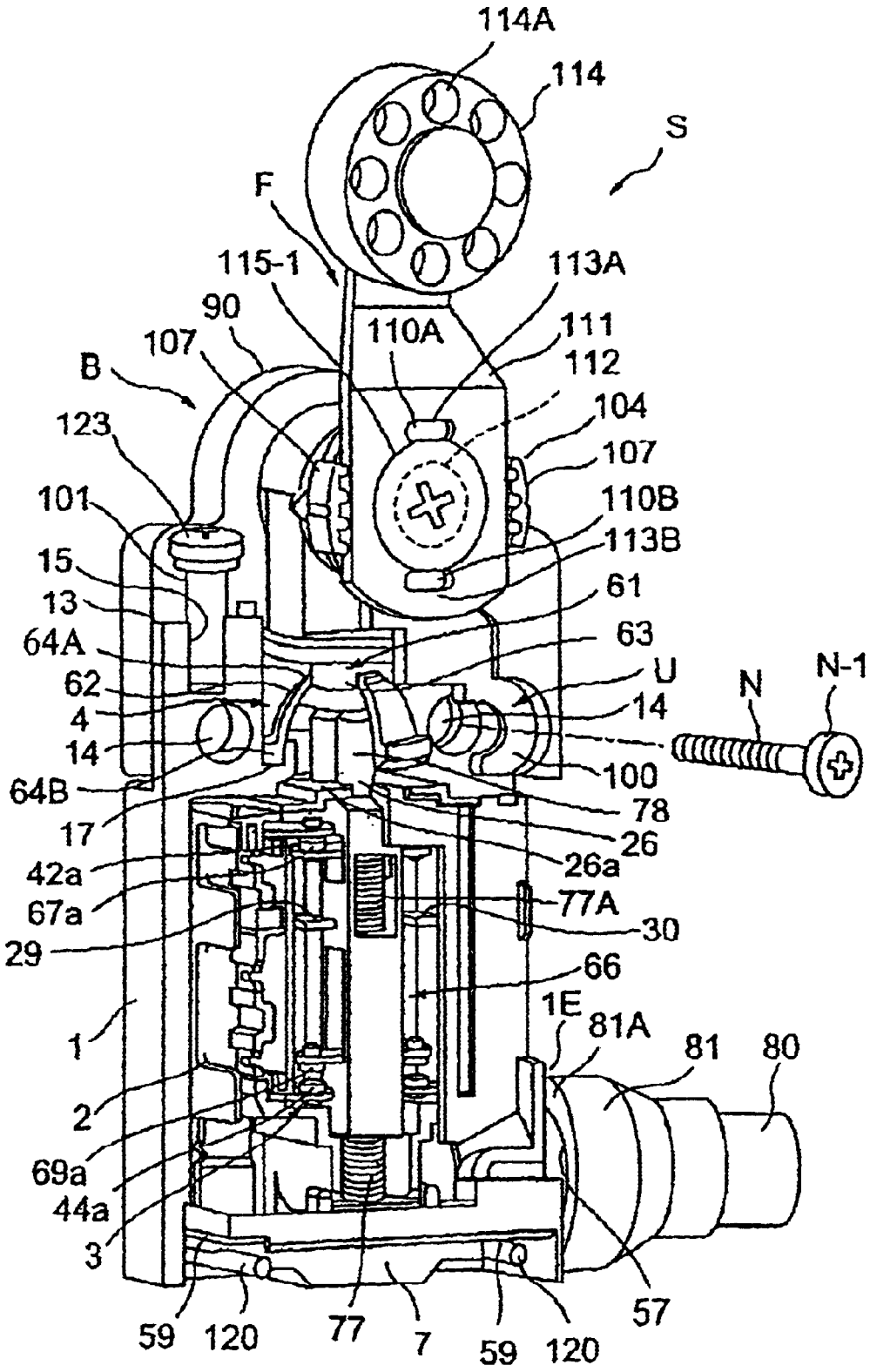
FIG. 2 is a partially broken diagonal view of the limit switch of FIG. 1.
Figure 4:
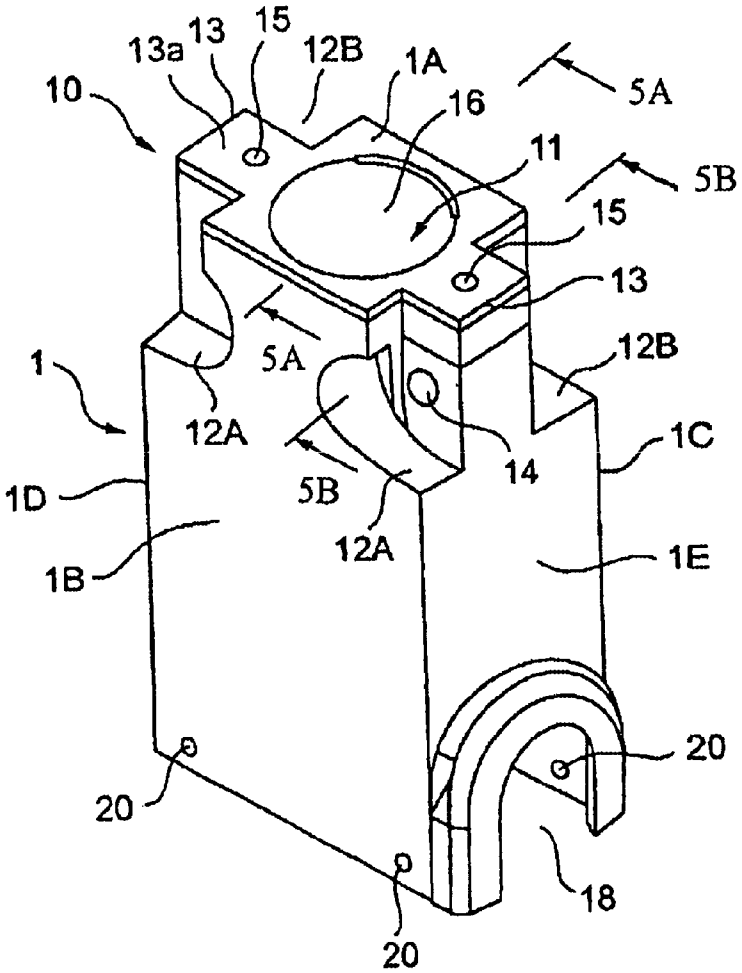
FIG. 4 is a diagonal view of the outer case of the limit switch of FIGS. 1 and 2.
Figure 5B:
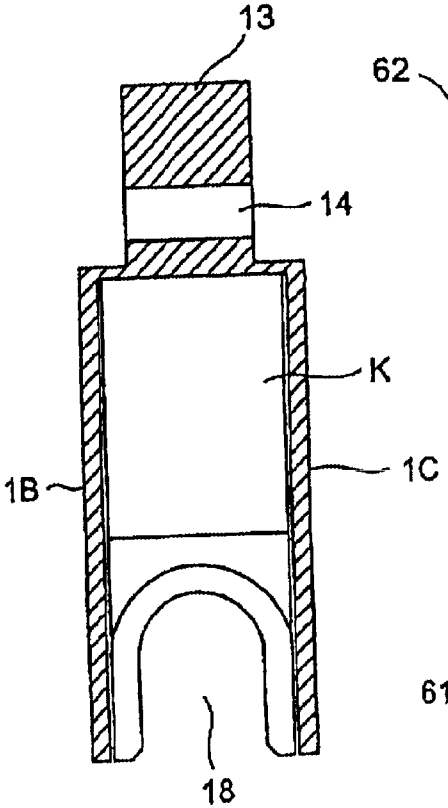
FIGS. 5A and 5B, together referred to as FIG. 5, are sectional views taken respectively along lines 5A—5A and 5B—5B of FIG. 4.
Figure 5A:
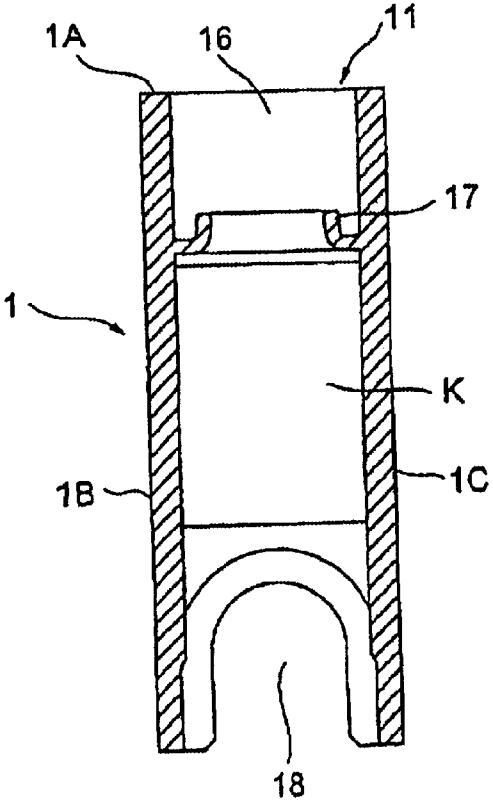
Figure 9:
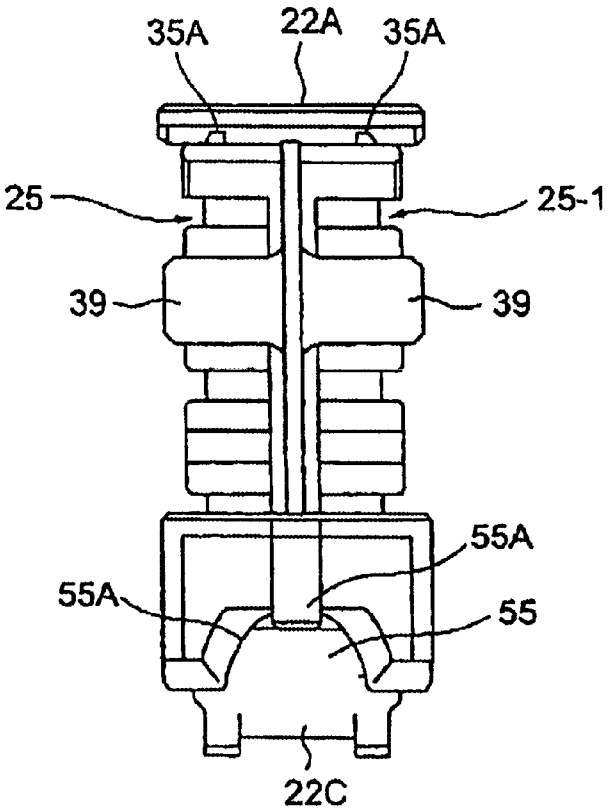
FIG. 9 is a side view of the switch case.
Figure 8:
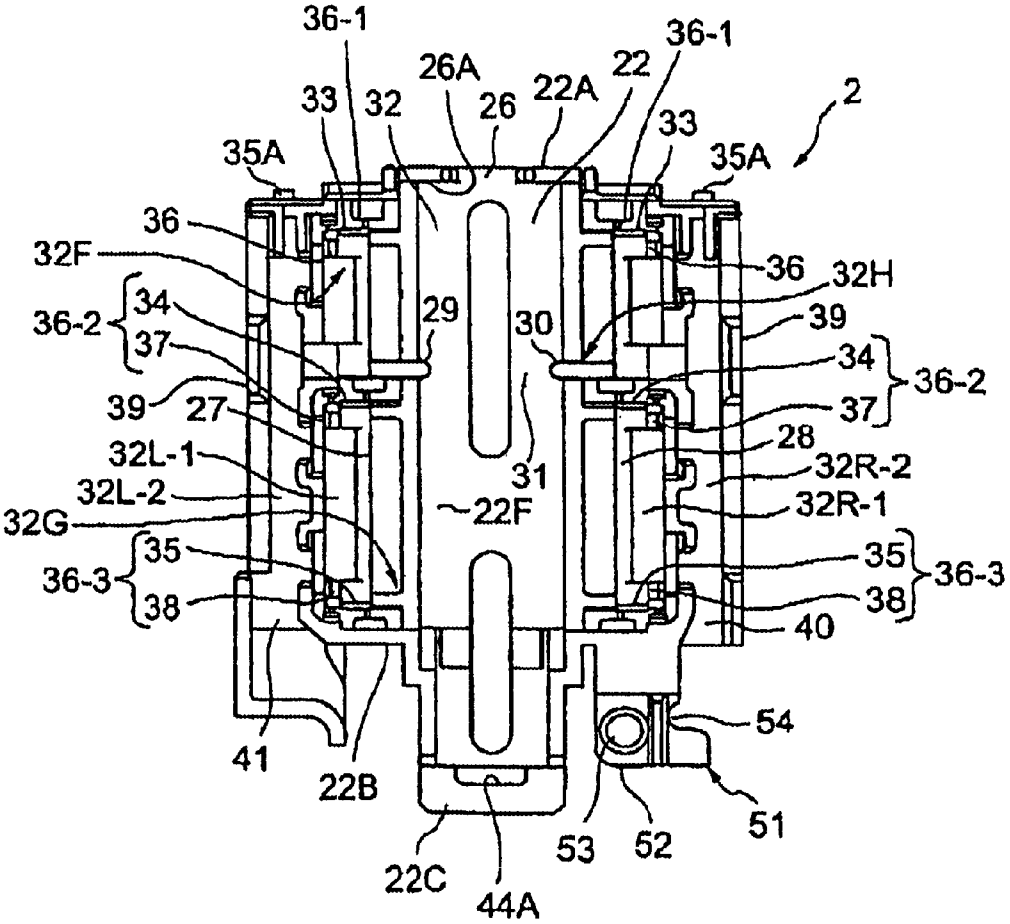
FIG. 8 is a front view of the switch case of the switch unit.
Figure 11:
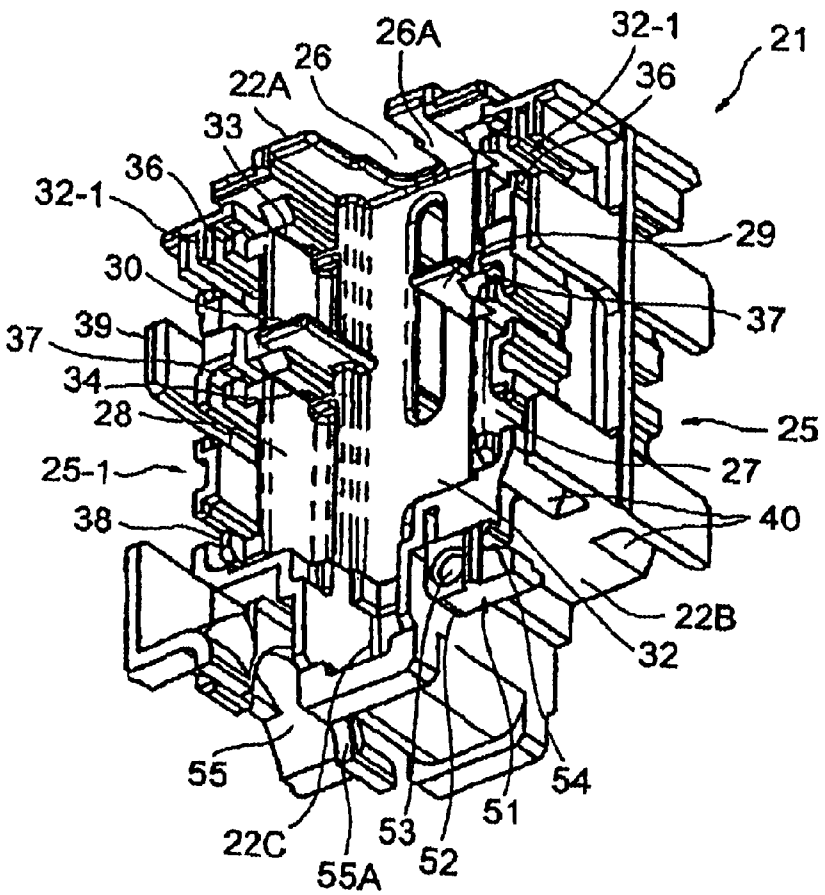
FIG. 11 is a diagonal view of the switch case taken from the lower left-hand side.
Figure 10:
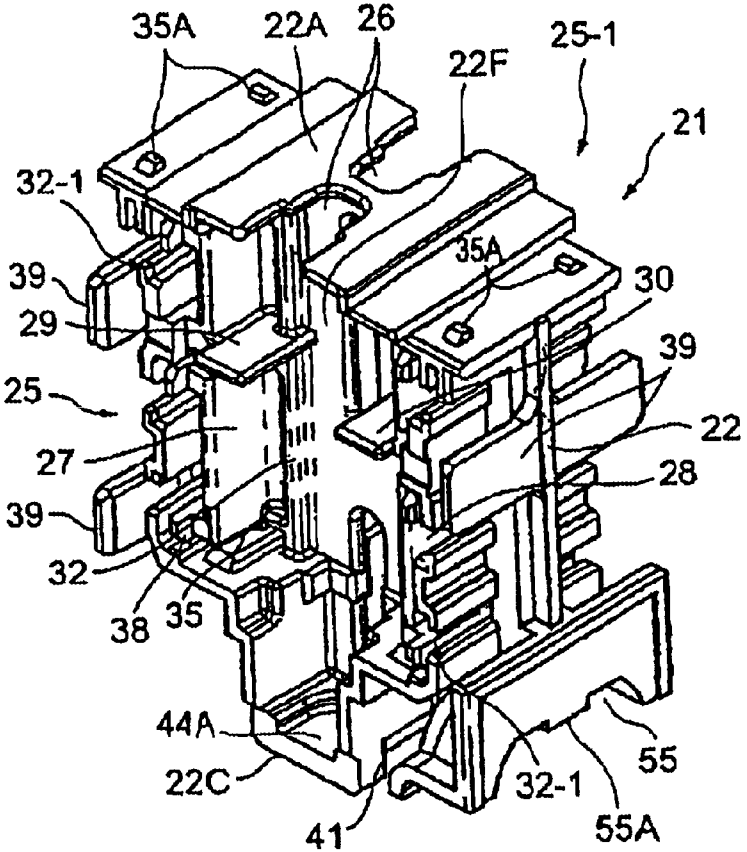
FIG. 10 is a diagonal view of the switch case taken from the upper right-hand side.

FIGS. 1 and 2 show a limit switch S embodying this invention, comprising a switch unit A and a head unit B. The switch unit A is comprised of an outer case 1 which serves as the main body of the switch, an inner switch 3 and a link plunger mechanism 4. As shown in FIGS. 4 and 5, the outer case 1 is box-shaped with an upper surface part 1A, a front surface part 1B, a back surface part 1C, a left-hand side surface part 1D and a right-hand side surface part 1E, the bottom being open.

A head unit attachment part 10 and a plunger attachment part 11 are formed on the upper surface part 1A of the outer case 1. The head unit attachment part 10 is formed by cutting off right-hand and left-hand end portions of the upper surface part 1A at the top of the front and back surface parts 1B and 1C of the outer case 1 to form indentations 12A and 12B and protrusions 13 sandwiched therebetween. Through-holes 14 in the front-back direction are provided through the protrusion 13, and screw holes 15 are provided on upper surface parts 13*a* of the protrusion 13.

The plunger attachment part 11 is provided with a circular hole 16 formed at the center of the upper surface part 1A of the outer case 1 so as to be sandwiched between the two protrusions 13. This circular hole 16 opens to the center of a ceiling part of the interior space K of the outer case 1. A seal cap holder 17 is provided inside the hole 16.

A cable opening 18 is provided at the lower right-hand end part of the outer case 1, and pin-receiving holes 20 are formed on the right-hand and left-hand side end parts near the lower end parts of the front and back surfaces parts 1B and 1C of the outer case 1.

Figure 6:
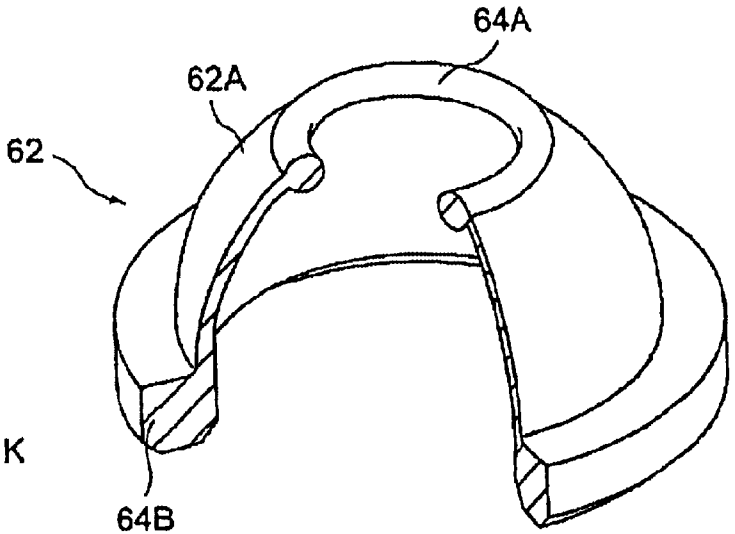
FIG. 6 is a partially broken diagonal view of the seal cap.
Figure 7:
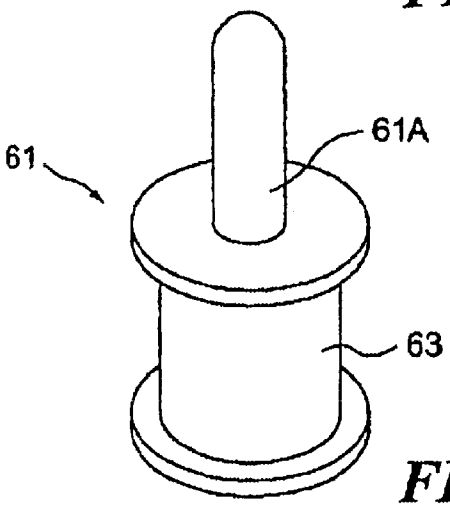
FIG. 7 is a diagonal view of the link plunger.

As shown in FIG. 2, the link plunger mechanism 4 includes a link plunger 61 and a seal cap 62. As shown in FIG. 7, the link plunger 61 has a cap engaging part 63 at one end of its rod-shaped main body 61A. The seal cap 62 is made of an elastic material such as rubber. As shown in FIG. 6, its main body 62A is shaped like a dome. An upper engagement part 64A shaped like an O-ring is formed on its upper end and an annular lower engagement part 64B is formed on its lower end.

As shown in FIG. 2, the seal cap 62 is attached to the link plunger 61 by engaging its upper engagement part 64A with the cap engagement part 63 of the link plunger 61, and the link plunger 61 is attached to the outer case 1 by engaging the lower engagement part 64B of the seal cap 62 with the seal cap holder 17 inside the plunger attachment part 11.

The inner switch 3 is contained inside an inner case 2 comprised of a switch case 21, two switch covers 5 and 6 and a fastening case 7. As shown in FIGS. 8–11, the switch case 21 has a planar main body 22 with its surface part forming a partition wall part 22F. Switch areas 25 and 25-1 are formed in front of and behind this partition wall part 22F, sandwiching the partition wall part 22F in between. A switch plunger containing part 32 for containing a switch plunger (to be described below), attachment parts 32L-1 and 32R-1 which are on both sides of this switch plunger containing part 32 and serve to detachably attach fixed terminals (to be described below), lead line areas 32L-2 and 32R-2 which are disposed along these attachment parts 32L-1 and 32R-1 and serve to dispose lead lines to connected to the fixed terminals, upper and lower switch element containing parts 32F and 32G for containing switch element units of the inner switch to be described below and a screening member 32H for separating the upper and lower switch element containing parts 32F and 32G are formed in these switch areas 25 and 25-1.

The main body 22 of the switch case 21 has an upper surface 22A having a cut part 26 at its center and protrusions 35A formed on the right-hand and left-hand sides. The main body 22 also has a lower surface 22B at the center of which is a bag-shaped member 22C protruding downward. A spring receiver 44A is provided at the bottom of this bag-shaped member 22C.

Left-hand and right-hand vertical ribs 27 and 28 are formed respectively in the switch areas 25 and 25-1, extending parallel to each other. The vertical ribs 27 and 28 are respectively provided with a horizontal rib 29 or 30 extending towards the center of the case main body 22. The switch plunger containing part 32 is formed with the upper surface part 22A, a gap 31 between the two horizontal ribs 29 and 30 and the bag-shaped member 22C. An edge portion of the cut part 26 at the upper surface 22A serves as a stopper part 26A.

Grooves 33, 34 and 35 are formed at upper, middle and lower parts of the pair of ribs 27 and 28, and engaging parts 36, 37 and 38 are formed outside of the case main body 22 at its upper, middle and lower parts, the lower engaging parts 38 being formed in opposite direction to the upper and middle engaging parts 36 and 37. The upper grooves 33 and the upper engaging parts 36 together form upper installation parts 36-1, the middle grooves 34 and the middle engaging parts 37 together form middle installation parts 36-2, and the lower grooves 35 and the lower engaging parts 38 together form lower installation parts 36-3 for the fixed terminals. Of these installation parts 36-1, 36-2 and 36-3, those on the left-hand side and those on the right-hand side are respectively referred to as the left-hand and right-hand attachment parts 32L-1 and 32R-1.

A tongue-shaped member 39 is formed on the left-hand and right-hand edge parts of the case main body 22 and the aforementioned lead line areas 32L-2 and 32R-2 are formed between the tongue-shaped member 39 and the engagement parts 36, 37 and 38 on both sides. Left-hand and right-hand lead line inlets 40 and 41 are provided on the left-hand and right-hand parts of the lower surface 22B. The left-hand lead line inlet 40 connects to the left-hand lead line area 32L-2 and the right-hand lead line inlet 41 connects to the right-hand lead line area 32R-2.

The upper installation parts 36-1 form the aforementioned upper switch element containing parts 32F, and the lower installation parts 36-3 (or the middle installation parts 36-2) form the lower inner switch element containing parts 32G. The horizontal ribs 29 and 30 form the screening member 32H for separating the upper and lower switch element containing parts 32F and 32G.

A grounding line holder 51 is formed on the lower surface 22B of the case main body 22, having a protrusion 52 from the lower surface 22B, a grounding line inlet 53 and an indentation 54 for winding the grounding line around. A semispherical indentation 55 and protrusion 55A are formed on the right-hand side of the lower surface 22B.

Figure 14A:
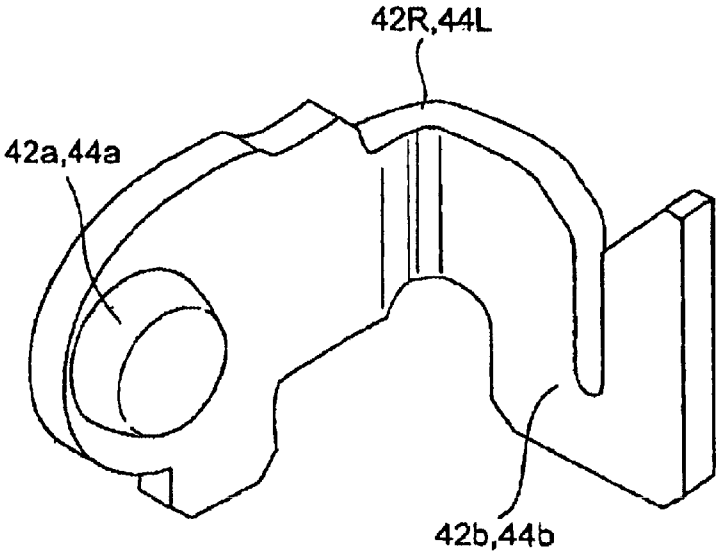
FIGS. 14A and 14B, together referred to as FIG. 14, are respectively a diagonal view of a fixed terminal and a sectional view of the cable.

Fixed terminals are intended to be installed on the upper, middle and lower installation parts 36-1, 36-2 and 36-3. Since this example is for a two-element structure (with two circuits), fixed terminals are installed only on the upper and lower installation parts 36-1 and 36-3. The fixed terminal 42L installed on the upper left-hand installation part 36-1 and the fixed terminal 44R installed on the lower right-hand installation part 36-3 are of the same structure. As shown in FIG. 14, these two fixed terminals 42L and 44R each have a compression contact part 42*b* or 44*b* at the base and a fixed contact part 42*a* or 44*a*. Similarly, the fixed terminal 42R installed on the upper right-hand installation part 36-1 and the fixed terminal 44L installed on the lower left-hand installation part 36-3 are of the same structure, which is the reverse of that of the fixed terminals 42L and 44R.

Fixed terminals 42L and 42R are positioned in the upper switch element containing part 32F and are engaged with the upper left-hand and right-hand engagement parts 36, their end parts being inserted into the grooves 33. Similarly, fixed terminals 44L and 44R are positioned in the lower switch element containing part 32G and are engaged with the lower engagement parts 38, their end parts being inserted into the grooves 35.

Figure 12:
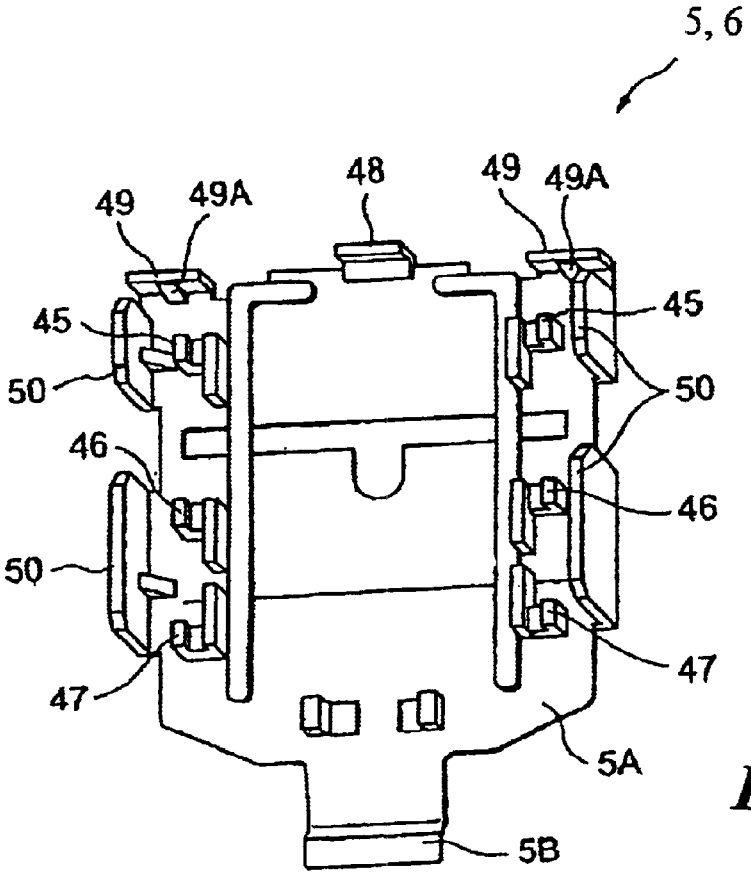
FIG. 12 is a diagonal view of the switch cover of the switch unit seen from inside.

As shown in FIG. 12, the switch covers 5 and 6 are shaped so as to cover the switch area 25. On the left-hand side and right-hand side of the inner surface of their planar main body 5A are protrusions 45, 46 and 47 serving as compressing means for upper, middle and lower parts. A tongue-shaped member 48 is provided at the center along the upper edge of the main body 5A and engaging members 49 having a hole 49A are provided on the left-hand and right-hand sides. Tongue-shaped members 50 are also provided on the left-hand and right-hand edge parts of the main body 5A, and a protrusion 5B is provided on the lower edge part of the main body 5A.

Figure 13A:
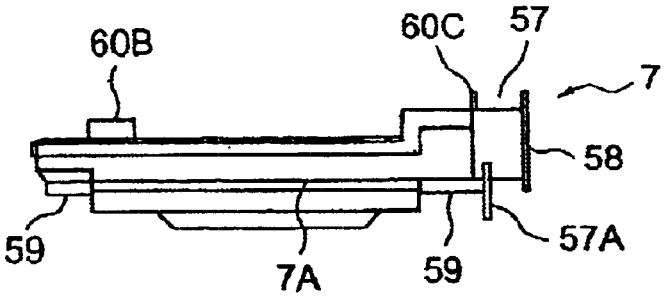
FIGS. 13A and 13B, together referred to as FIG. 13, are respectively a front view and a plan view of the fastening case of the switch unit.
Figure 13B:
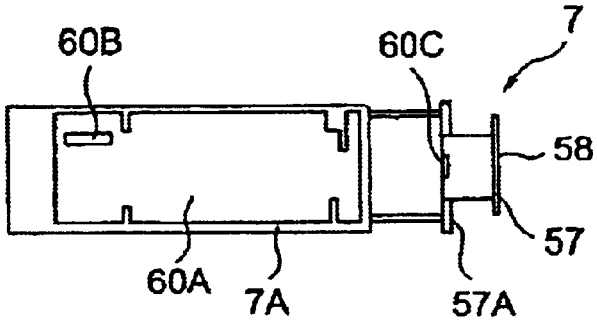

As shown in FIGS. 13A and 13B, the fastening case 7 has a rectangular main body 7A. An engagement plate 57A having an annular cable holder 57 is formed on the right-hand side of this main body 7A and a brim-shaped engagement part 58 for a sealing material is provided to this cable holder 57. A protrusion 60C is formed at an upper part of the cable holder 57, and pin-contacting parts 59 on the left-hand and right-hand parts of the outer surface part (lower surface part) of the main body 7A. An engagement part 60A and a protrusion 60B for pressing on the grounding line are provided on the inner surface of the main body 7A.

Figure 14B:
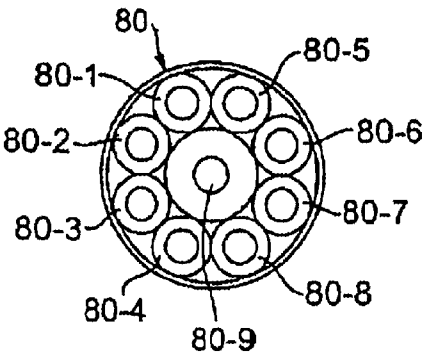

As shown in FIG. 2, a cap-shaped sealing member 81 made of rubber is provided to a cable 80 which penetrates the annular cable holder 57 of the fastening case 7, and the sealing member 81 engages with the brim-shaped engagement part 58. As shown in FIG. 14B, eight lead lines 80-1–80-8 of the cable 80 are divided equally to the left-hand and right-hand sides, there being a grounding line 80-9 at the center of the cable 80. The four lead lines 80-1–80-4 on the left-hand side are led through the left-hand lead line inlet 40, two in front and two at back, to the left-hand lead line area 32L-2 and are connected by compression to the compression contact parts 42*b* and 44*b* of the forward and backward left-hand fixed terminals 42L and 44L. Similarly, the four lead lines 80-5–80-8 on the right-hand side are led through the right-hand lead line inlet 41, two in front and two in back, to the right-hand lead line area 32R-2 and are connected by compression to the compression contact parts 42*b* and 44*b* of the forward and backward right-hand fixed terminals 42R and 44R.

The inner switch 3 is comprised of the fixed terminals 42L, 42R, 44L and 44R, a switch plunger 66, mobile members 67 and 69 having mobile contact points 67*a* and 69*a* and being supported by the switch plunger 66 through holding springs 77A and 77B serving as elastic holding members and a returning spring 77 serving as an elastic return-biasing member.

Figure 15A:
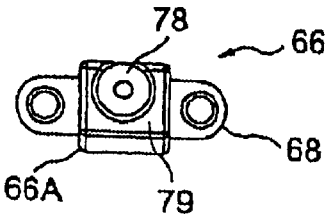
FIGS. 15A, 15B and 15C, together referred to as FIG. 15, are respectively a plan view, a front view and a side view of the switch plunger.
Figure 15B:
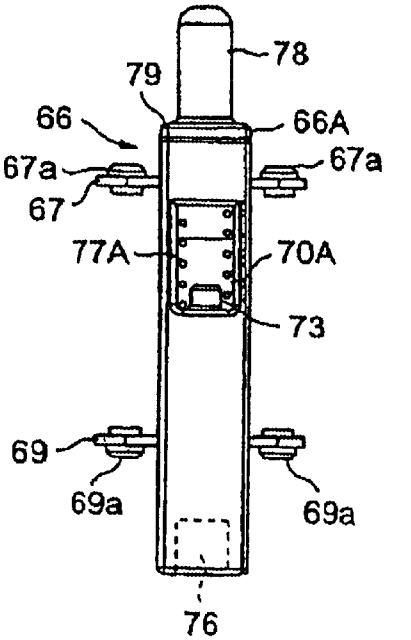
Figure 15C:
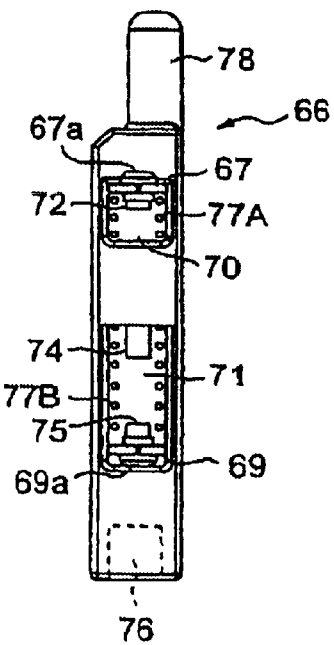

As shown in FIG. 15, the switch plunger 66 has a main body 66A having a contact part 78 and a stopper part 79 provided on its upper part. On both side surfaces of the main body 66A are holes 70 and 71 which are elongated in its axial direction one above the other. Another hole 70A communicating with the hole 70 is formed on its front surface. Guides 72 and 73 are provided respectively at an upper part and a lower part of the upper hole 70, and guides 74 and 75 are provided respectively at an upper part and a lower part of the lower hole 71. A spring container 76 is provided on the lower surface of the main body 66A.

The mobile member 67 is movable upward and downward and provided to the upper guide 72 in the upper hole 70, being upwardly biased by the holding spring 77A. The mobile member 69 is movable upward and downward and provided to the lower guide 75 in the lower hole 71, being downwardly biased by the holding spring 77B.

As shown in FIG. 2, the switch plunger 66, structured as described above, is disposed inside the containing part 32 of the switch areas 25 and 25-1 in a vertically movable manner with its returning spring 77 inserted into the spring container 76. The returning spring 77 is received by the spring receiver 44A at the bottom of the bag-shaped member 22C of the switch plunger containing part 32. Thus, the switch plunger 66 is upwardly biased by the returning spring 77, and its contact part 78 at the top protrudes above the cut part 26 of the switch case 21. The stopper part 79 of the switch plunger 66 contacts the stopper part 26A on the upper surface part 22A of the case main body 22, and the left-hand and right-hand mobile contact points 67*a* of the mobile member 67 contact the fixed contact points 42*a* of the fixed terminals 42L and 42R to form a normally closed (NC) contact point part. The left-hand and right-hand mobile contact points 69*a* of the mobile member 69 are separated from the fixed contact points 44*a* of the fixed terminals 44L and 44R to form a normally open (NO) contact point part.

Figure 3:
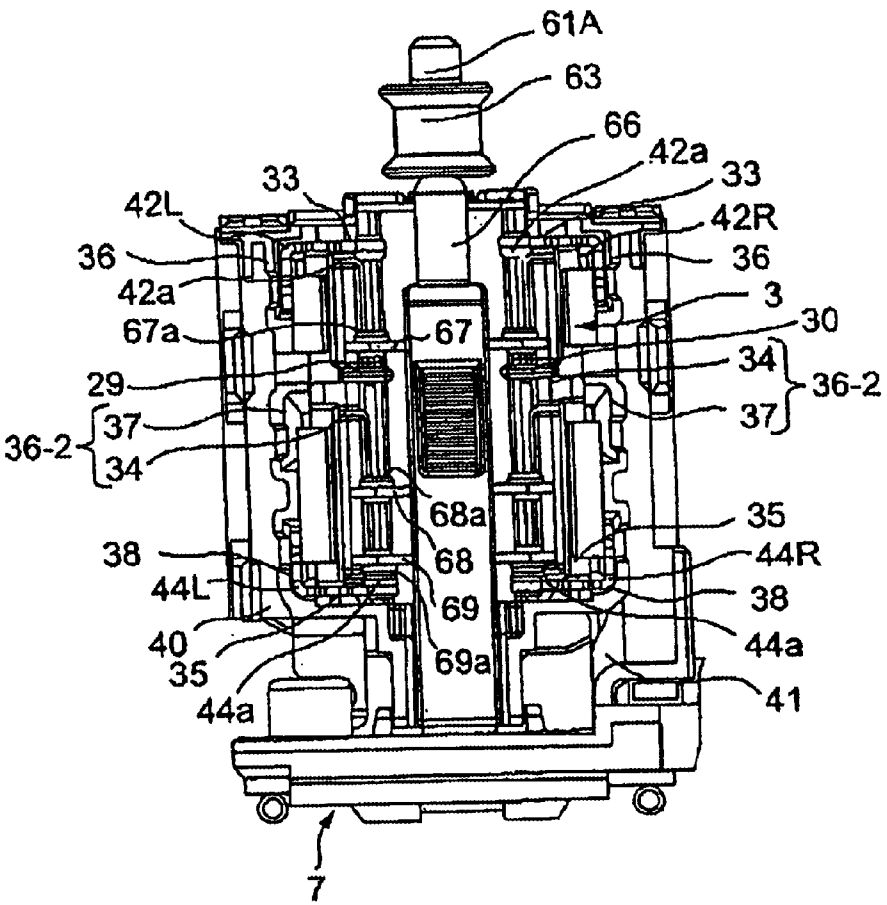
FIG. 3 is a front view of an inner switch in the switch unit of the limit switch of FIGS. 1 and 2.

The aforementioned upper switch element unit of the inner switch 3 is comprised of the left-hand and right-hand fixed terminals 42L and 42R, the mobile member 67 and the normally closed (NC) contact part. Likewise, the lower switch element unit of the inner switch 3 is comprised of the left-hand and right-hand fixed terminals 44L and 44R, the mobile member 69 and the normally open (NO) contact part. As shown in FIG. 3, these upper and lower switch element units are disposed respectively in the switch areas 25 and 25-1 of the switch case 21. The normally closed and open contact point parts are opened and closed as the switch plunger 66 is forcibly displaced.

As the switch covers 5 and 6 are set on the switch case 21, the switch areas 25 and 25-1 are thereby covered. In this situation, the tongue-shaped member 48 at the center along the upper edge of the covers 5 and 6 is inserted into the cut part 26 of the switch case 21, and the holes 49A of the left-hand and right-hand engaging members 49 engage detachably with the protrusions 35A on the switch case 21. The upper and lower protrusions 45 and 47 on the inner surfaces of the switch covers 5 and 6 compress the lead lines 80-1–80-8 compressed and connected to the compression contact parts 42*b* and 44*b* of the fixed terminals 42 and 44. The tongue-shaped members 50 on the left-hand and right-hand edge parts of the switch covers 5 and 6 engage with the tongue-shaped members 39 of the switch case 21 to seal in the switch element units of the inner switch 3. The grounding lines (not shown) of the cable 80 are connected to the grounding line holder 51 of the switch case 21, inserted into the grounding line inlet 53 and wound around the indentation 54.

The fastening case 7 is on the bottom surface of the switch case 21, having the bag-shaped member 22C of the switch case 21 and the protrusions 5B of the switch covers 5 and 6 covering this bag-shaped member 22C engaged with the engagement part 60A of the fastening case 7 and having the protrusion 60C engaged in a hole (not shown) on the switch case 21. The aforementioned switch unit A is formed by placing inside the outer case 1 the switch case 21 having the switch covers 5 and 6 and the fastening case 7 attached thereto.

Thus, when the switch case 21 with the switch covers 5 and 6 and the fastening case 7 attached thereto is disposed inside the outer case 1, the contact part 78 on the upper part of the switch plunger 66 contacts the link plunger 61 of the outer case 1 from below. The engagement plate 57A of fastening case 7 engages with the cable opening 18 at the lower edge part of the right-hand side surface part 1E of the outer case 1. A contact surface part 81A of the end cap 81 contacts the right-hand side surface part 1E of the outer case 1.

Holder pins 120 are inserted into the left-hand and right-hand pin-receiving holes 20 on the lower edge parts of the front and back surface parts 1B and 1C of the outer case so as to connect them. The holder pins 120 contact the pin-contacting parts 59 on the left-hand and right-hand parts of the outer surface part (lower surface part) of the fastening case 7 to keep the switch case 21 inside the outer case 21. The protrusion 60B compresses the grounding line 80-9 wound around the indentation 54, causing it to contact the inner surface of the outer case 1 by means of the elastic nature of the grounding line holder 51.

The cable 80, thus inserted into the cable holder 57 of the fastening case 7, is sandwiched between the semispherical indentation 55 in the lower surface part 22B of the case main body 22 and the fastening case 7, the protrusion 55A at the indentation 55 compressing the cable 80. The opening on the lower surface of the outer case 1 is filled with a sealing resin (not shown) serving as an adhesive to make the switch unit A resistant against water. Since the protrusion 55A compresses the cable 80, the sealing resin is prevented from flowing into the inner switch 3.

Figure 16:
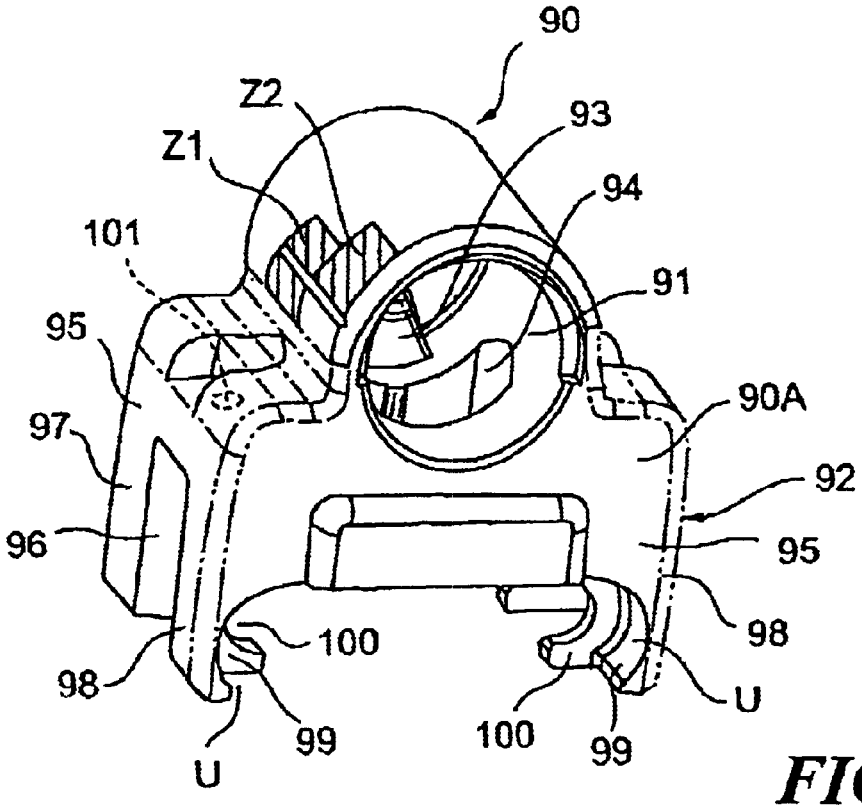
FIG. 16 is a diagonal view of the head case of the head unit.

The head unit B is provided with a head case 90. As shown in FIG. 16, the head case 90 has a main body 90A with a shaft receiving part 91 formed at its upper part and an engaging part 92 at its lower part. A stopper 93 is formed at an end surface part of the shaft receiving part 91, and the periphery of the shaft receiving part 91 is provided with an opening 94 communicating with the engaging part 92. Two set zones Z1 and Z2 are prepared on the outer surface of the head case 90 by coloring or by uneven surface characteristic (protrusions and indentations). The engaging part 92 has covering parts 95 on its left-hand and right-hand sides, each having two legs 97 and 98 on both sides of a cut part 96. Each of these legs 97 and 98 is provided with a cut part 99 and a semicircular screw-receiving part 100 which together form an attachment part U. At both shoulder parts of the covering part 95 is a hole 101 communicating with the cut part 96.

Figure 17:
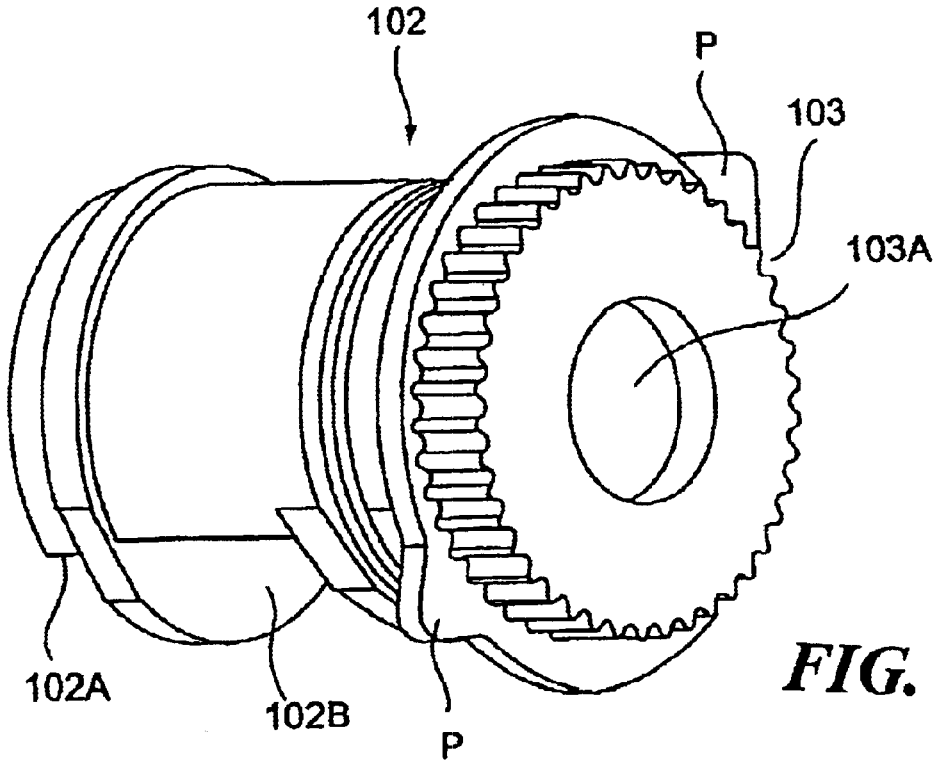
FIG. 17 is a diagonal view of the rotary shaft of the head unit.

The head case 90 in provided with an actuator F of which the rotary shaft 102 as shown in FIG. 17 is rotatably inserted into the shaft receiving part 91 of the head unit B. The rotary shaft 102 has a semicircular stopper 102A formed on its back end part, an indented cam part 102B formed on its peripheral part, a roulette part 103 with many gear teeth formed on its front surface part and also a set zone indicator P.

Figure 18A:
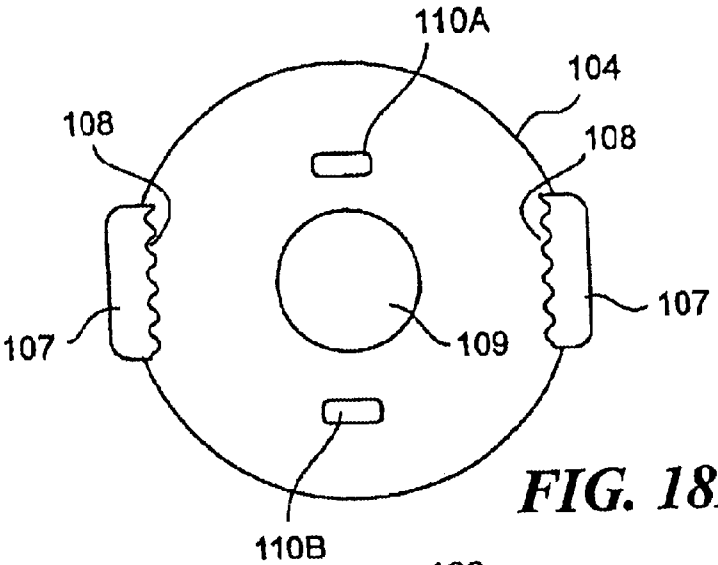
FIGS. 18A and 18B, together referred to as FIG. 18 are respectively a view of the outer surface and the inner surface of the lever angle adjusting member of the head unit.
Figure 18B:
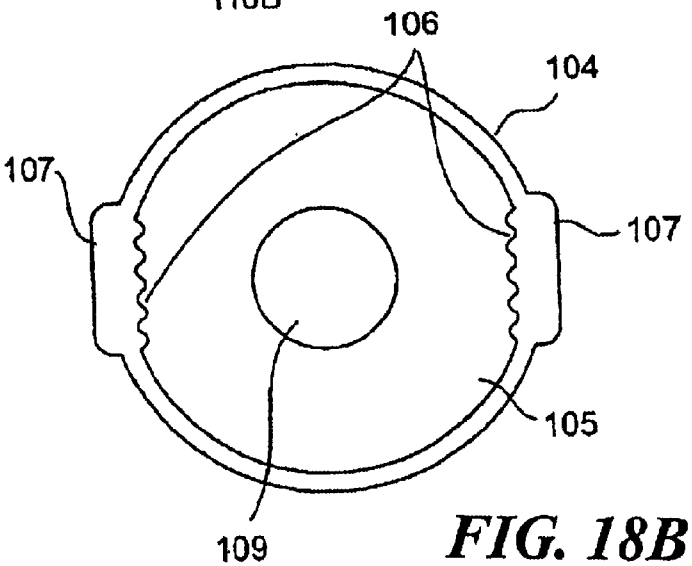

At the front end of the rotary shaft 102 is a lever angle adjuster 104 having, as shown in FIG. 18, an indentation 105 on its inner surface part. Corresponding roulette parts 106 are formed on the peripheral wall parts of this indentation 105. A mutually opposite pair of lever holders 107 is formed on the outer surface part of the lever angle adjuster 104. Engagement parts 108 are formed on mutually opposite parts of these lever holders 107 as shown in FIG. 18A. A hole 109 is formed at the center of the lever angle adjuster 104 and protrusions 110A and 110B are formed above and below the hole 109.

As shown in FIG. 2, the lever 111 has a screw hole 112 and engagement holes 113A and 113B on its base part and supports a roller 114 axially at its upper part. The lever angle adjuster 104 is attached to the front end part of the rotary shaft 102 by engaging the roulette parts 103 and 106 together. The lever 111 is attached to the outer surface part of the lever angle adjuster 104 by inserting the protrusions 110A and 110B into the engagement holes 113A and 113B. After a screw member 115-1 is inserted into the screw hole 112 in the lever 111 and the hole 109 through the lever angle adjuster 104, it is screwed into a screw hole 103A through the front end surface part of the rotary shaft 102 and is tightened so as to fasten the lever 111 to the tip of the rotary shaft 102. A plurality of holes 114A are formed on the roller 114.

A mobile member 115 is slidably inserted into the opening 94 communicating from the periphery of the shaft receiving part 91 to the engaging part 92. An upper part of this mobile member 115 is inserted into the cam part 102B of the rotary shaft 102.

Figure 19:
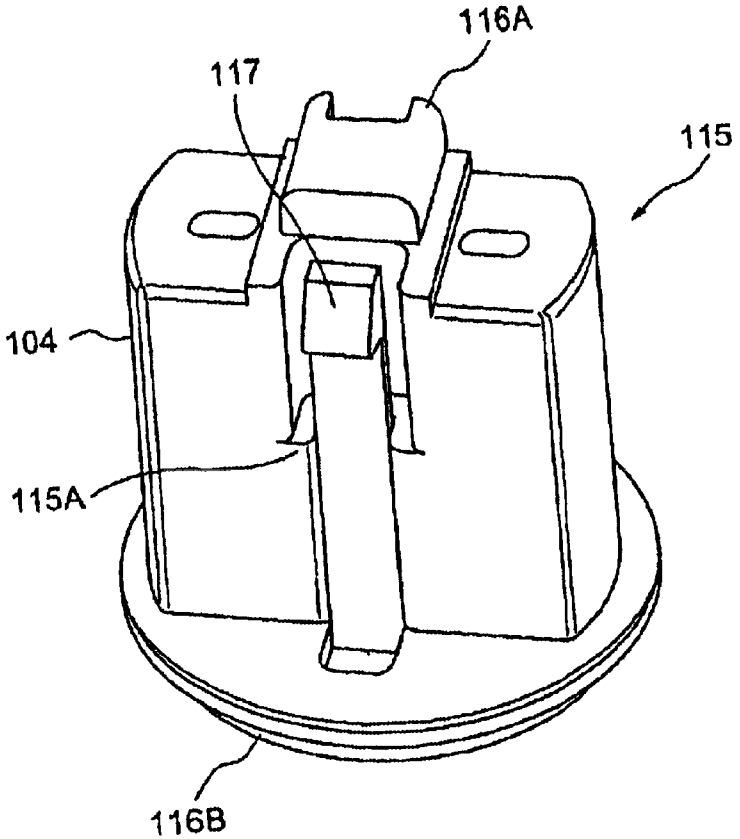
FIG. 19 is a diagonal view of the mobile member of the head unit.

As shown in FIG. 19, this mobile member 115 has a main body 115A cross-sectionally shaped similarly to the sectional shape of the opening 94. A protrusion 116A is formed at the upper end part of this main body 115A, and a brim-like member 116B is formed at its lower end part. At the center of the lower end surface is a plunger-receiving opening (not shown). A claw 117 as a hooking device is provided on its side surface. When the mobile member 115 is inserted into the opening 94, the claw 117 contacts the peripheral surface of the opening 94 by its elastic force in order to prevent it from falling off and rattling.

When the head unit B and the switch unit A are assembled, the engaging part 92 of the head unit B is attached to the head unit attachment part 10 at the upper part of the outer case 1 of the switch unit A, that is, the left-hand and right-hand protrusions 13 on the upper part of the outer case 1 are inserted into the cut parts 96 of the covering parts 95 of the engaging part 92, and the legs 97 and 98 of the left-hand and right-hand covering parts 95 are inserted into the indentations 12A and 12B at the upper part of the outer case 1. Another screw member 123 is inserted into the hole 101 at each shoulder part of the covering part 95 to attach the head unit B to the switch unit A.

When the head unit B and the switch unit A are thus assembled, the cut part 99 of an attachment part U of the engaging part 92 and the screw-receiving part 100 are outside of the throughhole 14 of the outer case 1, and the link plunger 61 attached to the plunger attachment part 11 through the seal cap 62 is inserted into a plunger receiving part on the lower end surface of the mobile member 115. Thus, the force of the returning spring 77 of the inner switch 3 presses the mobile member 115 upward through the switch plunger 66 and the link plunger 61, and the protrusion 116A at the upper end part of the mobile member 115 contacts the cam part 102B of the rotary shaft 102.

When the limit switch S, thus assembled, is installed on some structure ("target structure"), an attachment screw member N is passed through each protrusion 14 of the outer case 1, as shown in FIG. 2, and screwed tightly into a corresponding screw hole (not shown) prepared on the target structure. As the screw member N is tightened, the head part N-1 of the screw member N contacts the semicircular screw-receiving part 100 of the attachment part U, and the back surface of the engaging part 92 contacts the target structure directly (unless a spacer is inserted in between).

Rigidity of the limit switch S is thus improved since the engaging part 92 of the head unit B is attached to the head unit attachment part 10 of the outer case 1 of the switch unit A. Since the limit switch S is attached to a target structure through the head unit B, the switch is less likely to become deformed or damaged at the time of its attachment to the target structure even if a foreign object is present and whether the outer case 1 of the switch unit A is made of a metallic or resin material.

When the limit switch S is to be operated, a moving body (a "dog") contacts the roller 114 of the actuator F, causing the lever 111 to tilt and the rotary shaft 102 to rotate. The mobile member 115 in contact with the cam part 102B of the rotary shaft 102 is thereby pushed downward against the force of the returning spring 77. Thus, as shown in FIG. 3, the switch plunger 66 is pushed down through the link plunger 61, causing the mobile contact points 67*a* on the mobile member 67 to be separated from the fixed contact points 42*a* on the fixed terminal 42 while the mobile contact points 69*a* on the mobile member 67 contact the fixed contact points 44*a* of the fixed terminal 44 such that the switched condition changes. According to the embodiment of the invention described above, the switch areas 25 and 25-1 are formed in front and at back of the switch case 21, each containing switch element units of the inner switch 3. Thus, in the case of a switch structure with four independent circuits as switch element unit, each of the switch areas 25 and 25-1 may house two of the circuits such that the limit switch S can be structured compactly with a small height.

Since the switch areas 25 and 25-1 are provided as explained above, each containing a switch element unit of the inner switch 3, and each of the switch element unit is covered and sealed by a switch cover 5 or 6, the switch according to this invention has an improved insulation characteristic.

Figure 20A:
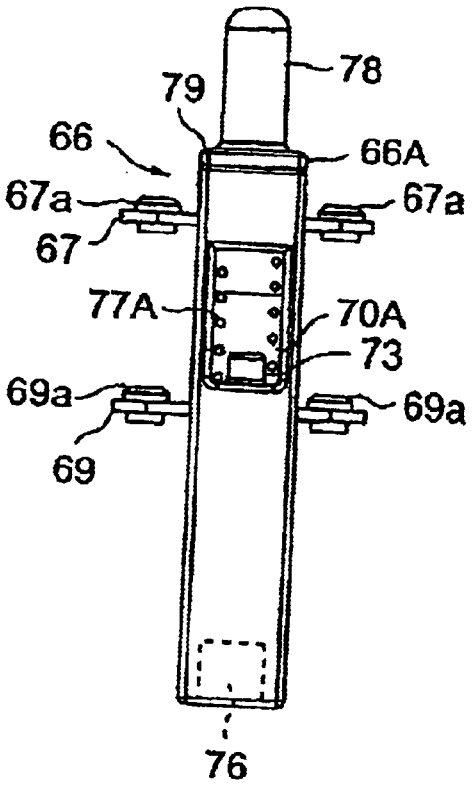
FIGS. 20A and 20B, together referred to as FIG. 20, are respectively a front view and a side view of the switch plunger after mobile members have been replaced.
Figure 20B:
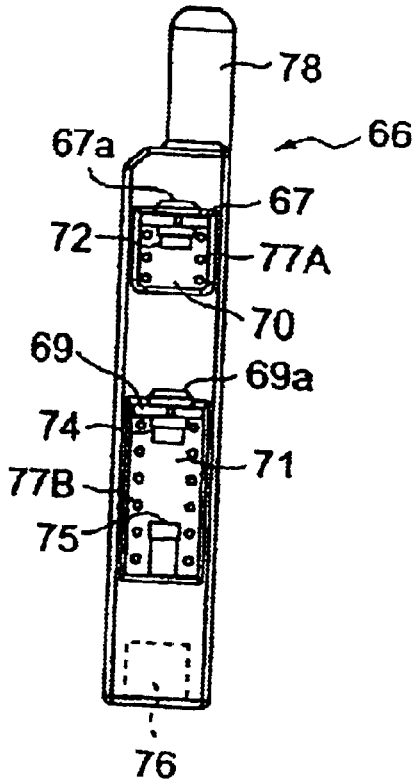
Figure 21A:
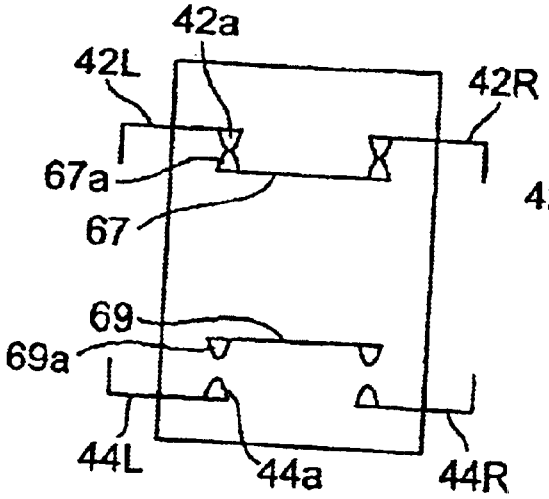
FIGS. 21A and 21B, together referred to as FIG. 21, are diagrams respectively of two circuits each having a normally open contact point and a normally closed contact and two circuits both having a normally closed contact point.
Figure 21B:
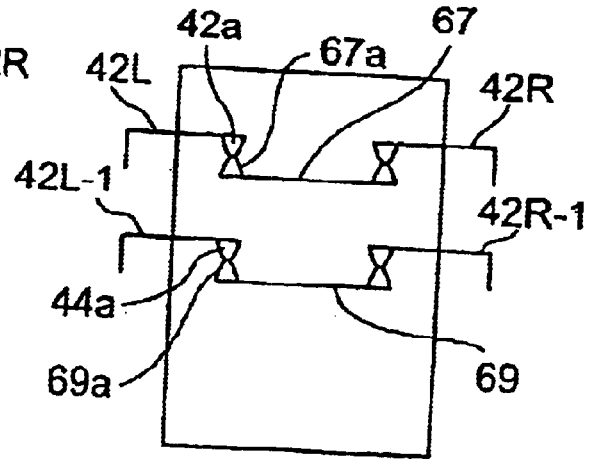
Figure 22:
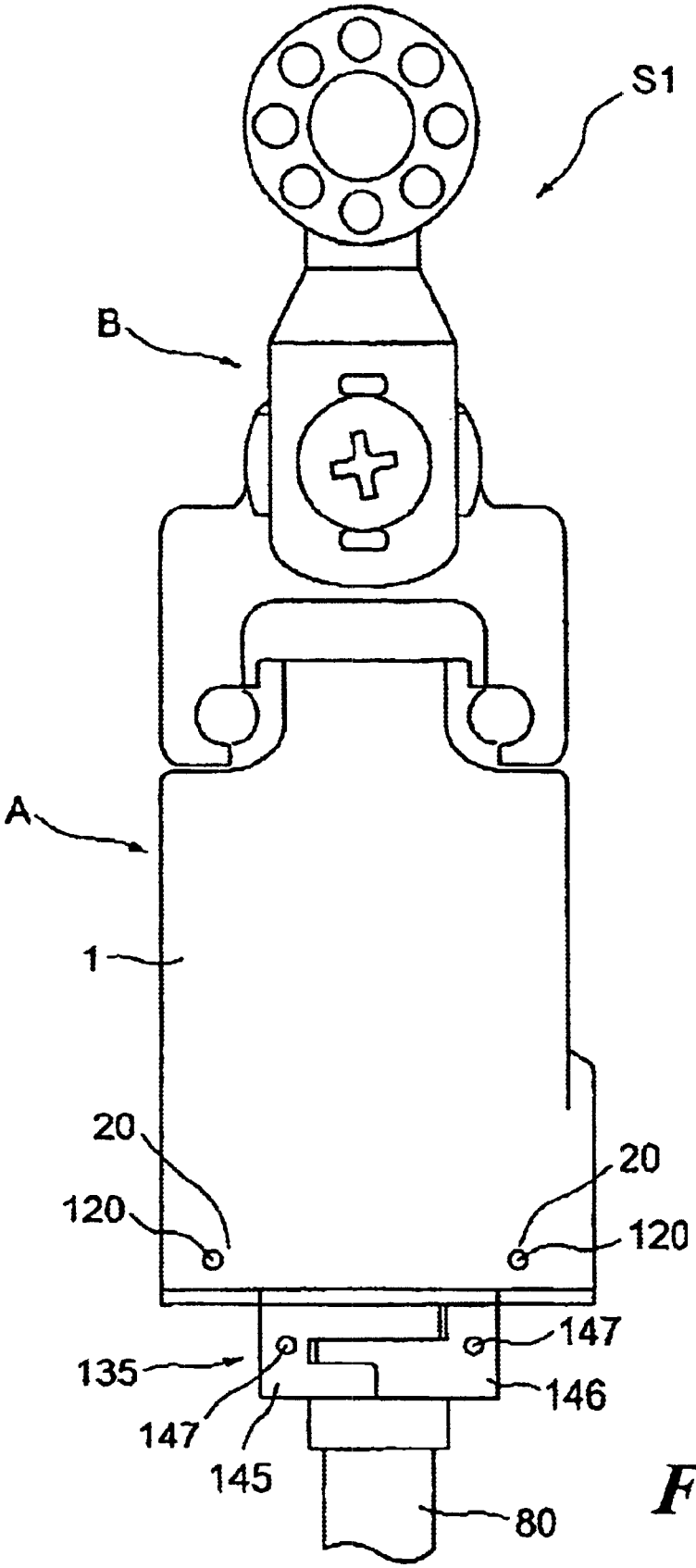
FIG. 22 is a front view of another limit switch according to a second embodiment of the invention.

The structure of the contact points can be modified easily according to the present invention without using different components but merely by changing the position of the fixed and mobile members. For example, the fixed terminals 44L and 44R may be removed, and fixed terminals 42L-1 and 42R-1 having the same structures as terminals 42L and 42R may be detachably attached to the middle installation parts 36-2. As for the switch plunger 66, the mobile member 67 is kept in the same way as shown in FIG. 15 but the mobile member 69 may be introduced to the guide 74 and biased upward by means of the holding spring 77B so as to change its position, as shown in FIG. 20. If the switch plunger 66, thus slightly modified, is disposed in the switch plunger containing part 32 of the switch areas 25 and 25-1 so as to be vertically movable with the returning spring 77 positioned in the spring container 76, the change is as shown in FIG. 21, FIG. 21B showing both circuits having normally closed (NC) contact points. Thus, the structure of contact parts can be varied inexpensively in many ways because common components are used.

Another advantage of the embodiment described above is that the switch plunger 66 of the inner switch 3 is operated by the link plunger 61 which is another component and hence the switch can be unitized. Since there is no effect on the shape of the actuator, many variations can be easily developed. Since the seal cap 62 has the same function as an O-ring, the switch is better sealed and the link plunger 61 can better follow the switch plunger 66. Since the grounding line 80-9 is connected to the grounding line holder 51 of the switch case 21 and is compressed to the outer case 1 by the elastic property of this grounding line holder 51, dedicated components such as pins are not required and there is no need for punching holes through the outer case 1 for such components. This makes the entire structure simpler.

Since the adhesive can be prevented from flowing toward the inner switch 3 because the cable 80 is sandwiched between the switch case 21 and the fastening case 7, a separate component such as a rubber piece for preventing the flow, as well as an extra work step for its installation, can be dispensed with. Neither is any extra device necessary to affix the cable 80, and the cable 80 becomes stronger against being pulled out because the adhesive is hardened with the cable 80 bent by the protrusion 55A from the switch case 21. Since the compression contact parts 42*b* and 44*b* are provided on the fixed terminals 42L, 42R, 44L and 44R and the lead lines 80-1–80-8 are arranged symmetrically inside the cable 80 and compressed by the protrusions 45, 46 and 47 formed on the switch covers 5 and 6, the production process is not only simpler but also environmentally gentler than the prior art method by soldering, and the lines can be arranged efficiently. Since the roulette part 106 of the lever angle adjuster 104 is provided only partially and not entirely around, the production is easier without adversely affecting the accuracy of adjustment. Since the roller 114 is provided with many holes 114A, it is made lighter and has improved resistance against shock and vibrations. Since less material is needed, the production cost is also reduced. Since the protrusion 116A is formed on the mobile member 115 where it contacts the cam part 102B, the action of the plunger can be adjusted at will, while the plunger is being pushed according to a sine curve corresponding to the angle of rotation of the lever according to prior art technologies.

Figure 23:
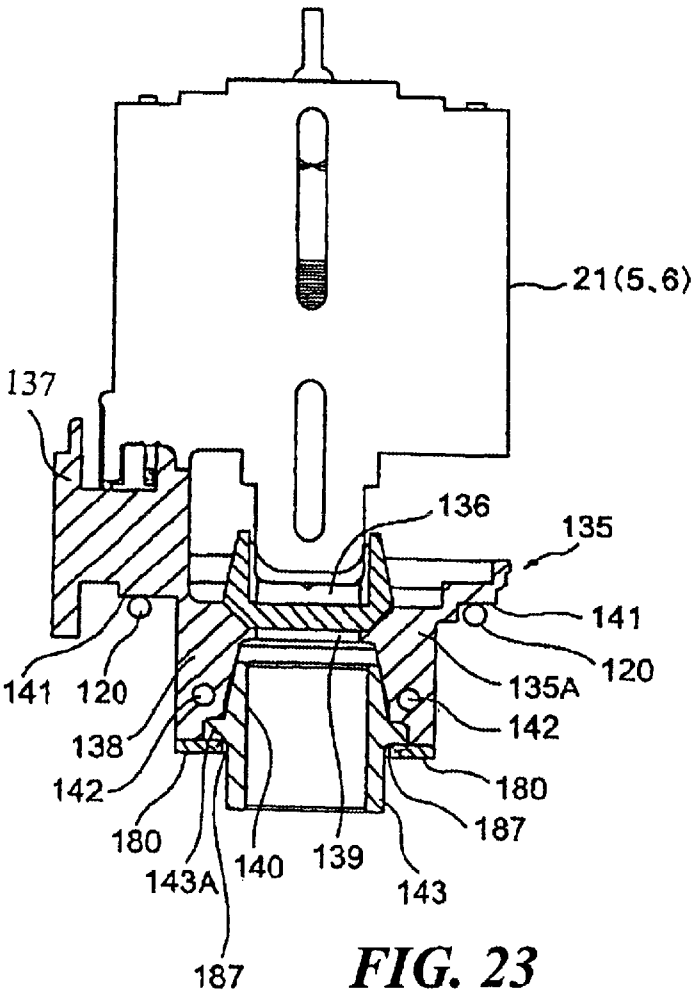
FIG. 23 is a sectional view of the fastening case of the limit switch of FIG. 22.

FIGS. 22–25 are referenced next to describe another limit switch S1 according to a second embodiment of the invention characterized as having the cable 80 connected at bottom and being provided with a different fastening case 135. This fastening case 135 has a rectangular main body 135A, as shown in FIG. 23, with a closing plate 137 formed on one side and an engagement part 136 and a protrusion (not shown) on the inner surface of the main body 135A. A quadrangular columnar protrusion 138 is formed on its lower surface. A cable hole 139 is provided from the inner surface of the main body 135A to the lower surface of this columnar protrusion 138, its lower end serving as a sealing member receiving part 140. Pin contacting parts 141 are provided on the left-hand and right-hand sides of the lower surface of the main body 135A. Pin insertion holes 142 are formed in the front-back direction through the columnar protrusion 138.

The fastening case 135 is attached to the bottom part of the switch case 21 with the switch covers 5 and 6 installed. The bag-shaped member 22C of the switch case 21 and the protrusions 5B and 6B of the switching covers 5 and 6 covering this bag-shaped member 22C are engaged to the engagement part 136. The switch case 21 thus having the switch covers 5 and 6 and the fastening case 7 attached to it is contained in the outer case 1. The cable opening 18 at the lower edge part of the right-hand surface 1E of the outer case 1 is blocked by the engagement part 136 of the fastening case 135. The holder pins 120 are inserted into the left-hand and right-hand pin-receiving holes 20 on the front and back surfaces 1B and 1C of the outer case 1, extending therebetween. These holder pins 120 contact the left-hand and right-hand pin contacting parts 141 to support the switch case 21. The protrusion 138 from the fastening case 135 extends to the exterior of the outer case 1, and a cap-shaped sealing member 143 penetrated by the cable 80 is inserted into the sealing member receiving part 140. A sealing ring 143A is formed on the outer periphery of this sealing member 143.

Figure 24:
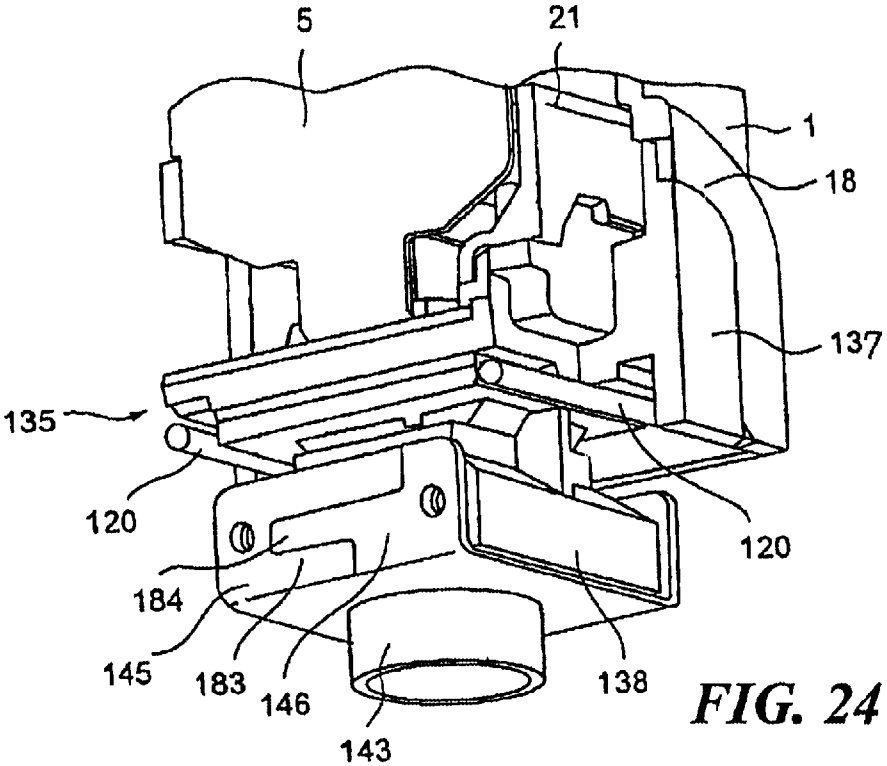
FIG. 24 is a diagonal view of the fastening case of FIG. 23 for showing its attachment.
Figure 25:
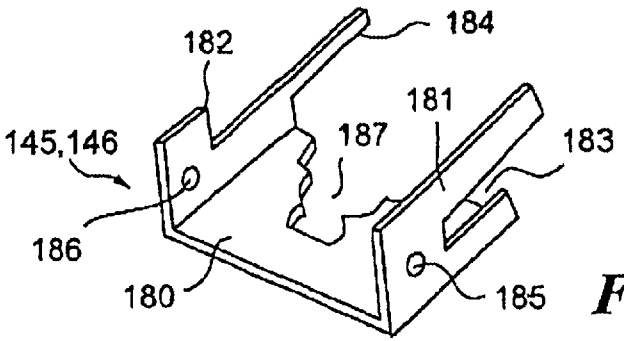
FIG. 25 is a diagonal view of the seal holder.

FIG. 25 shows the structure of a mutually engaging pair of seal holders 145 and 146. The seal holders 145 and 146 each have bent parts 181 and 182 at both edges, one of the bent parts (181) having a cut 183 and the other (182) having a protrusion 184. Both bent parts 181 and 182 have a pin hole (185 or 186) and its surface part 180 has an approximately semicircular insertion area 187 prepared. These seal holders 145 and 146 are attached to the protrusion 138 by inserting holding pins 147 from the pin holes 185 and 186 into the pin insertion holes 142 such that the protrusion 184 of one of them will fit into the cut 183 of the other, as shown in FIG. 24. The sealing member 143 is then sandwiched, as shown in FIG. 23, in the insertion area 187 and the sealing ring 143A of the sealing member 143 is compressed both in the radial and vertical directions to provide a complete sealing.

In the other aspects, the limit switch S1 according to the second embodiment is the same as the limit switch S according to the first embodiment.

The second embodiment is advantageous in that the seal members 145 and 146 hold the cable 80 tightly and since these seal members 145 and 146 are identically shaped, the number of different components for the production can be reduced.

As shown in FIGS. 16 and 17, two kinds of set zones Z1 and Z2 are formed on the outer surface of the head case and a set zone indicator P is provided to the rotary shaft 102 such that these set zones Z1 and Z2 can be selectively used for two kinds of inner switches 3 with different action characteristics. In other words, only one head unit B is required for these two kinds of inner switches with different action characteristics.

Figure 26:
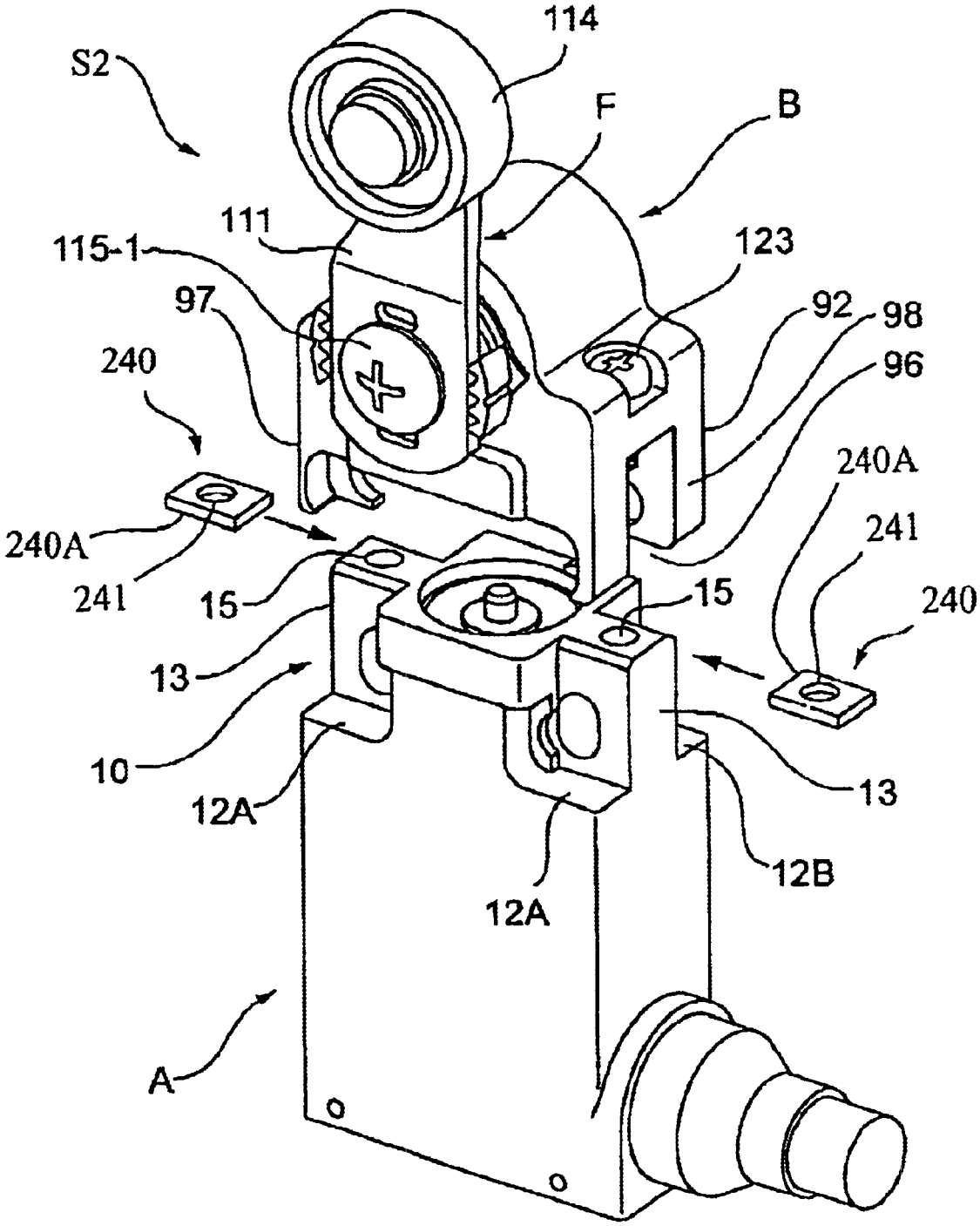
FIG. 26 is a diagonal view of still another limit switch according to a third embodiment of the invention, separated into parts.

FIG. 26 shows another limit S-2 switch according to a third embodiment of the invention, which is the same as the limit switch S according to the first embodiment of the invention described above except that spacers 240 are inserted between the head unit B and the switch unit A to serve as means for changing the position of the head unit B in the direction of displacement of the switch plunger 66 of the inner switch 3. Each of the spacers 240 comprises a planar main body 240A of a size nearly equal to that of the upper surface of the protrusion 13 of the outer case 1, having a hole 241 at its center.

When the head unit B is attached to the switch unit A, the spacers 240 are placed on the upper surface part of the protrusion 13 of the outer case 1 and the engagement part 92 of the head unit B is engaged with the head unit attachment part 10 at the upper part of the outer case 1 of the switch unit A by inserting the left-hand and right-hand protrusions 13 into the cut part 96 and the protrusions 97 and 98 into the indentations 12A and 12B. The screw members 123 are then inserted through the holes 101 and 241 and screwed into the screw holes 15.

With the spacers 240 thus inserted between the switch unit A and the head unit B, the head unit B can be displaced with respect to the switch unit A in the direction of movement of the switch plunger 66 of the inner switch 3 and to thereby change the action characteristic of the inner switch 3. It now goes without saying that the relative position of the head unit can be changed by making the head unit B as a different component.

Figure 27B:
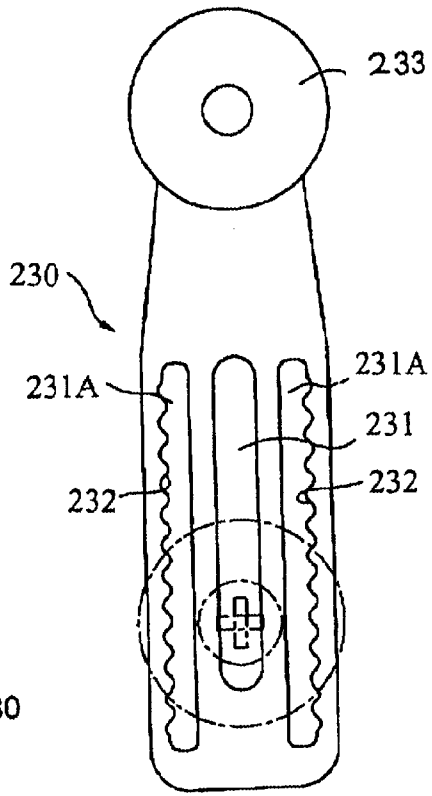
FIG. 27B is a front view of a form-lock lever formed differently.
Figure 27A:
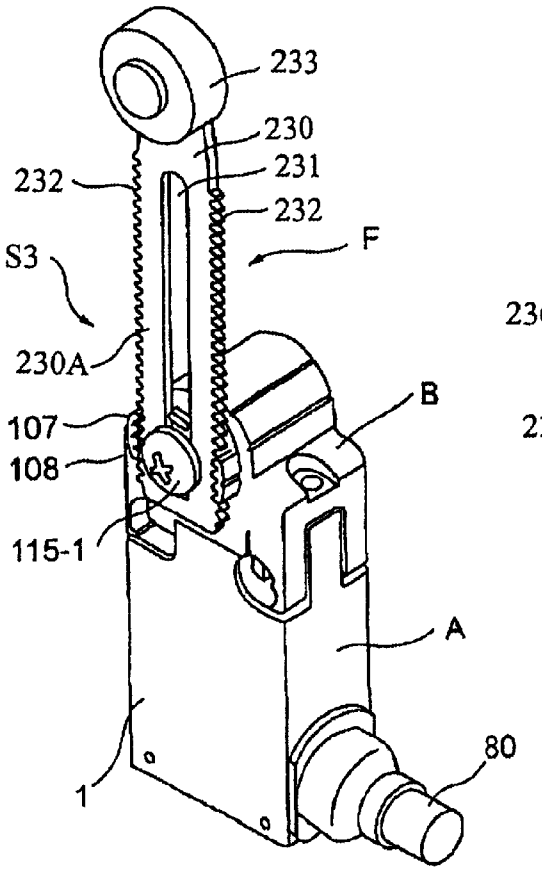
FIG. 27A is a diagonal view of still another limit switch embodying this invention.
Figure 29A:
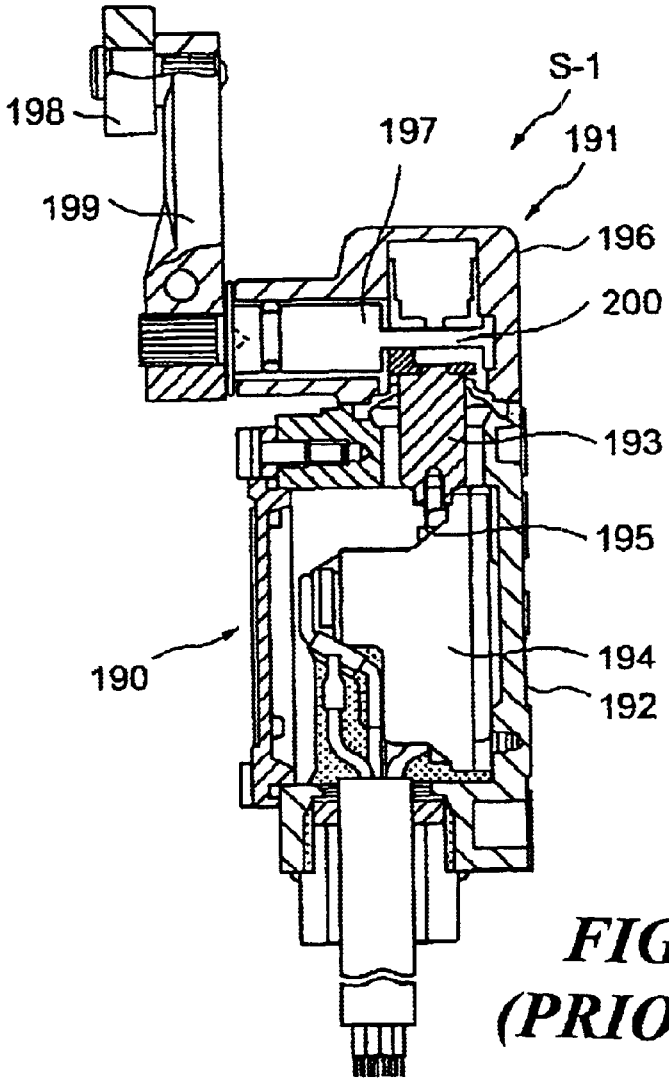
FIG. 29A (PRIOR ART)
FIG. 29A is a vertical sectional view of a prior art limit switch and FIG. 29B is its schematic side view when it is being installed on a target structure.
Figure 29B:
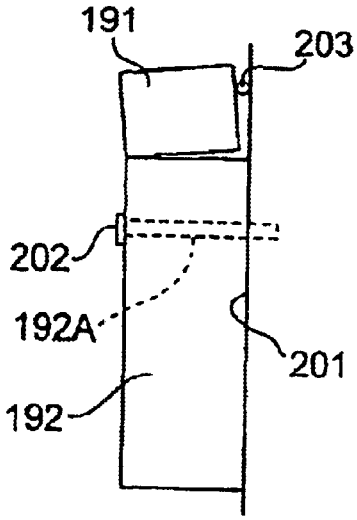
FIG. 29B (PRIOR ART)

FIG. 27A shows still another limit switch S3 according to a third embodiment of the invention, characterized as having a form-lock lever 230 for its actuator F capable of adjusting its length. As shown in FIG. 27A, this form-lock lever 230 comprises an elongated main body 230A with a longitudinally elongated opening 231. On both outer edge parts of the main body 230A are toothed gear parts 232, and a roller 233 is axially supported at the tip.

With the roulette parts 103 and 106 engaged with each other at an end part of the rotary shaft 102, as explained above regarding the switch S according to the first embodiment of the invention, the form-lock lever 230 is placed next to the outer surface part of the lever angle adjuster 104, and the toothed gear parts 232 are engaged with the engagement parts 108 of the lever holders 107. Thereafter, the screw member 115-1 is inserted through the opening 231 of the form-lock lever 230 and the hole 109 of the lever angle adjuster 104 and screwed into the screw hole 103A at the front end surface part of the rotary shaft 102. The form-lock lever 230 with the roller 233 is thus attached to the rotary shaft 102 by tightening the screw member 115-1.

When the length of the form-lock lever 230 is to be changed, the screw member 115-1 is removed and the form-lock lever 230 is separated from the lever angle adjuster 104 and displaced upward or downward. The form-lock lever 230 is thereafter positioned against the lever angle adjuster 104, its toothed parts 232 are engaged with the engagement parts 108 of the lever holders 107, and the screw member 115-1 is again inserted through the opening 231 of the form-lock lever 230 and the hole 109 of the lever angle adjuster 104 and screwed into the screw hole 103A at the front end surface part of the rotary shaft 102. In the other respect, the switch S3 is structured in the same way as the switch S according to the first embodiment of the invention.

As a variation, the form-lock lever 230 may have toothed openings 231A with the toothed parts 232 and the central opening 231 formed separately, as shown in FIG. 27B. This design is safer to operate because the toothed gear parts 232 are not facing outward and stronger because the openings 231 and 231A are separated.

Figure 28:
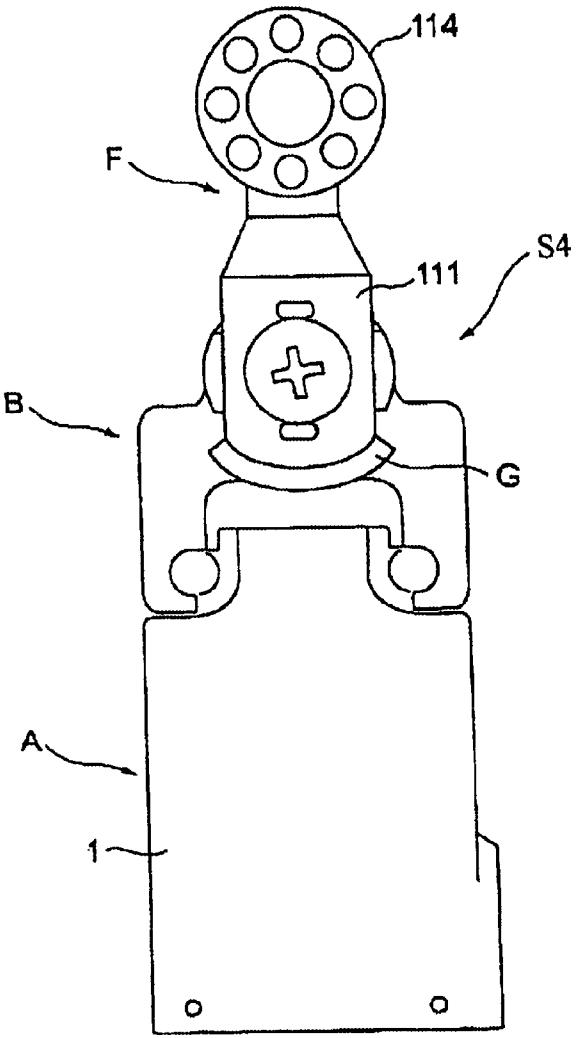
FIG. 28 is a front view of still another limit switch embodying this invention.

FIG. 28 shows still another limit switch S4 embodying this invention characterized as having a weight G added to the lever 11 of the actuator F on the side opposite to the roller 114 such that the center of gravity of the lever 111 shifts closer to its axis of rotation and hence that the resistance against shock and vibrations will be improved.

As should be clear from the disclosure above, limit switches according to this invention are made more rigid and less likely to be damaged at the time of installation and may be assembled without requiring extra components for preventing damage or deformation.

What is claimed is:

1. A limit switch comprising:

an inner switch having a plurality of switch element units; and an inner case containing said inner switch, said inner case having covers and a switch case including a partition wall and independently provided switch areas which sandwich said partition wall in between, said switch element units being distributed individually into said switch areas, said covers each sealing a corresponding one of said switch areas.

2. The limit switch of claim 1 wherein at least four of said switch element units are independent.

3. The limit switch of claim 2 wherein said switch areas include screening members for separating said switch element units when said switch element units are contained in said switch areas.

4. The limit switch of claim 3 wherein said switch element units each include a fixed terminal having a first fixed contact point and a second fixed contact point, a mobile member having a first mobile contact point and a second mobile contact point and a switch plunger, said first fixed contact point and said first mobile contact point forming a first contact unit, said second fixed contact point and said second mobile contact point forming a second contact unit, said switch plunger serving to open and close said first contact unit and said second contact unit.

5. The limit switch of claim 4 wherein said switch areas include:

a switch plunger containing part for containing said switch plunger;

fixed terminal attachment parts for installing said fixed terminals, said fixed terminal attachment parts sandwiching said switch plunger containing part from both sides; and lead line areas for placing lead lines disposed along said fixed terminal installation parts and connected to said fixed terminals.

6. The limit switch of claim 5 wherein said fixed terminal attachment parts include a plurality of fixed terminal installation parts along a direction in which said switch plunger moves, said fixed terminal installation parts serving to detachably install said fixed terminals, wherein said switch plunger comprises a switch plunger main body having a plurality of said mobile members detachably attached and an elastic holder for holding and biasing said mobile members, wherein said fixed terminals are detachably set to said fixed terminal installation parts, said switch plunger being biased by a returning spring when contained movably inside said switch plunger containing part.

7. The limit switch of claim 6 further comprising plunger means for operating said inner switch, said plunger means including a link plunger for operating the switch plunger of said inner switch.

8. The limit switch of claim 7 further comprising:

a case main body having a hole part for said link plunger to pass through; and a seal cap holder at said hole part for holding a seal cap;

said link plunger having a plunger engaging part, said seal cap having a cap main body made of an elastic material, first engaging part at one end part of said cap main body, and a second engaging part at another end part of said cap main body and formed as an O-ring, said link plunger being attached to said seal cap by engaging said first engaging part with said plunger engaging part and said second engaging part with said seal cap holder.

9. The limit switch of claim 5 wherein said inner case further includes a fastening case, said cable being sandwiched between said switch case and said fastening case as said lead lines of said cable are connected to said inner switch and said switch case is fastened to said fastening case.

10. The limit switch of claim 5 wherein said inner case further includes a fastening case, said lead lines of said cable being connected to said inner switch, said cable having a sealing member with a sealing ring outside, said fastening case having a cable-passing hole through which said cable passes, said sealing member being inserted into said cable-passing hole, said fastening case having a mutually engaging pair of seal holders, said cable being sealed by pressing said sealing ring with said seal holders.

11. The limit switch of claim 5 wherein said lead lines are connected to said fixed terminal by compressive connection.

12. The limit switch of claim 11 wherein said switch cover has compressing means on an inner surface for compressing compression connection parts of said lead lines.

13. The limit switch of claim 5 wherein said lead lines are arranged symmetrically within said cable.

14. The limit switch of claim 1 wherein said switch case includes an elastic grounding line holder with an elastic force, said grounding line holder holding a grounding line and causing said grounding line to contact said switch main body by said elastic force.

15. A limit switch comprising:

a switch unit;

a head unit which operates said switch unit;

a protrusion on either one of said switch unit and said head unit; and an indentation on the other of said switch unit and said head unit, said head unit being connected to said switch unit by engaging said protrusion with said indentation;

wherein said switch unit comprises a switch main body having shoulders, said protrusion being formed by steps at said shoulders, said head unit having a head case with two legs protruding to form said indentation therebetween.

16. The limit switch of claim 15 wherein said protrusion has an attachment hole part, a screw member being inserted in said attachment hole part serving to compress said legs to said protrusion to thereby fasten said switch main body and said head case together.

17. The limit switch of claim 16 wherein said switch unit contains an inner switch, said limit switch further comprising a head unit displacing means for moving said head unit in a direction in which a switch plunger in said inner switch moves.

18. The limit switch of claim 17 wherein said head unit displacing means includes a spacer inserted between said head unit and said switch unit.

19. A limit switch comprising:

a switch unit;

a head unit which operates said switch unit;

a protrusion on either one of said switch unit and said head unit; and an indentation on the other of said switch unit and said head unit, said head unit being connected to said switch unit by engaging said protrusion with said indentation;

wherein said head unit includes a head case and a rotary shaft rotatably supported by said head case, said head case displaying two or more set zones, said rotary shaft having a zone indicator for selectively indicating one of said set zones.

20. The limit switch of claim 19 further comprising:

a lever for rotating said rotary shaft;

a lever angle adjuster supporting said lever; and a roulette part formed on a portion of a peripheral part of said lever angle adjuster, said rotary shaft and said lever angle adjuster engaging together through said roulette part.

21. The limit switch of claim 20 wherein said lever is a form-lock lever having a pair of holes which are elongated in the direction of said lever and gear parts on sides of said elongated holes, said lever angle adjuster having a pair of lever holders with lever engaging parts, each of said lever holders being inserted to corresponding one of said elongated holes so as to engage said gear parts with said lever engaging parts so as to connect said form-lock lever with said lever angle adjuster.

22. A limit switch comprising:

a switch unit;

a head unit which operates said switch unit;

a protrusion on either one of said switch unit and said head unit; and an indentation on the other of said switch unit and said head unit, said head unit being connected to said switch unit by engaging said protrusion with said indentation;

wherein said head unit includes an actuator for operating said switch head, said actuator comprising:

a roller for a mobile member to contact;

a lever supporting said roller, said lever tilting when said mobile member contacts said roller; and a weight on said lever opposite to said roller.

* * * * *